US010766727B2

(12) United States Patent
Yanagiuchi et al.

(10) Patent No.: US 10,766,727 B2
(45) Date of Patent: Sep. 8, 2020

(54) PAPER SHEET PROCESSING DEVICE AND PAPER SHEET PROCESSING METHOD

(71) Applicant: GLORY LTD., Hyogo (JP)

(72) Inventors: Takahiro Yanagiuchi, Hyogo (JP); Jun Hisanaga, Hyogo (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 15/776,558

(22) PCT Filed: Nov. 17, 2016

(86) PCT No.: PCT/JP2016/084174
§ 371 (c)(1),
(2) Date: May 16, 2018

(87) PCT Pub. No.: WO2017/086408
PCT Pub. Date: May 26, 2017

(65) Prior Publication Data

US 2018/0370745 A1 Dec. 27, 2018

(30) Foreign Application Priority Data

Nov. 18, 2015 (JP) ..... 2015-225428

(51) Int. Cl.
*B65H 7/14* (2006.01)
*B65H 5/06* (2006.01)
(Continued)

(52) U.S. Cl.
CPC ..... *B65H 7/14* (2013.01); *B65H 5/062* (2013.01); *B65H 7/02* (2013.01); *G07D 7/00* (2013.01);
(Continued)

(58) Field of Classification Search
CPC . B65H 7/02; B65H 7/14; B65H 5/062; B65H 2553/41; B65H 2553/61; B65H 2701/1712
See application file for complete search history.

(56) References Cited

U.S. PATENT DOCUMENTS 4,451,854 A * 5/1984 Daigo ..... G06K 7/016 358/480
5,110,115 A 5/1992 Couper
(Continued)

FOREIGN PATENT DOCUMENTS

EP 0344967 A1 12/1989
JP 54-100061 8/1979
(Continued)

OTHER PUBLICATIONS

Extended European Search Report in counterpart application No. 16866409.2-1017/3373256, dated Nov. 30, 2018.
(Continued)

*Primary Examiner* — Howard J Sanders
(74) *Attorney, Agent, or Firm* — Greenblum & Bernstein, P.L.C.

(57) ABSTRACT

A paper sheet handling device (a banknote handling device) includes a paper sheet detection device (a tracking sensor) configured to detect a paper sheet, and a handling unit performing handling related to the paper sheet based on the time when the paper sheet detection device detects an end of the paper sheet. The paper sheet detection device includes a pair of rolling bodies (rollers) facing each other, disposed on a transport path transporting the paper sheet, and configured so that the paper sheet passes therebetween, and a detection unit detecting displacement of the rolling bodies when the paper sheet passes between the pair of rolling bodies to detect the paper sheet.

13 Claims, 13 Drawing Sheets

(51) Int. Cl.
*B65H 7/02* (2006.01)
*G07D 7/00* (2016.01)
*G07D 9/00* (2006.01)

(52) U.S. Cl.
CPC ..... *G07D 9/00* (2013.01); *B65H 2511/51* (2013.01); *B65H 2511/515* (2013.01); *B65H 2553/41* (2013.01); *B65H 2553/61* (2013.01); *B65H 2701/1712* (2013.01); *B65H 2701/1912* (2013.01)

(56) References Cited

U.S. PATENT DOCUMENTS

| | | | | |
|---|---|---|---|---|
| 8,267,401 | B2 * | 9/2012 | Nakajima | B41J 11/0095 271/258.01 |
| 2004/0208351 | A1 * | 10/2004 | Yoshida | G07D 7/164 382/137 |
| 2005/0280205 | A1 * | 12/2005 | Knierim | B65H 7/02 271/265.04 |
| 2010/0301551 | A1 | 12/2010 | Muranaka et al. | |
| 2010/0303332 | A1 | 12/2010 | Miki | |
| 2012/0137533 | A1 | 6/2012 | Muranaka et al. | |
| 2012/0313316 | A1 | 12/2012 | Yamamoto et al. | |
| 2013/0256987 | A1 | 10/2013 | Miki et al. | |
| 2015/0003718 | A1 | 1/2015 | Yamamoto et al. | |

FOREIGN PATENT DOCUMENTS

| | | |
|---|---|---|
| JP | 55-32384 | 3/1980 |
| JP | 62-93133 | 4/1987 |
| JP | 5-246576 | 9/1993 |
| JP | 7-325954 | 12/1995 |
| JP | 3191386 | 5/2001 |
| JP | 2003-91757 | 3/2003 |
| JP | 4086489 | 2/2008 |
| JP | 4819162 | 9/2011 |
| JP | 2012-252672 | 12/2012 |
| JP | 2013-142969 | 7/2013 |
| JP | 2014-29301 | 2/2014 |
| JP | 2014-182752 | 9/2014 |
| JP | 2015-95023 | 5/2015 |
| JP | 2015-138437 | 7/2015 |
| WO | 2009/075015 | 6/2009 |

OTHER PUBLICATIONS

Official Communication issued in International Patent Application No. PCT/JP2016/084174, dated Feb. 21, 2017, along with English Translation.

* cited by examiner (a)

(b)

(a)

(b)

(a)

(b)

(a)

(b)

PAPER SHEET PROCESSING DEVICE AND PAPER SHEET PROCESSING METHOD

TECHNICAL FIELD

The technique disclosed herein relates to a paper sheet handling device for handling a paper sheet having a transparent part, and a paper sheet handling method.

BACKGROUND ART

In recent years, more countries have issued banknotes called polymer banknotes using synthetic paper. Paper used for banknotes is mainly made of vegetable fiber material, but synthetic paper made of synthetic polymer material is used for the purpose of improving durability, water resistance, security, etc.

A polymer banknote is generally made by applying a printing processing to synthetic paper and further applying a coating processing to the synthetic paper. Polymer banknotes made by combination of synthetic paper and vegetable fiber paper, and polymer banknotes having synthetic paper part and vegetable fiber paper part are also being developed. Further, the techniques for polymer banknotes are also used for securities such as gift certificates, checks and bills.

Paper sheets such as the polymer banknotes and the securities might have transparent parts to which a printing processing is not applied. Handling of the paper sheets having the transparent parts is more difficult than handling of the paper sheets having no transparent part. As one example of handling of a paper sheet having a transparent part, handling of a polymer banknote having a transparent part will be described below.

In a banknote handling device for handling banknotes including polymer banknotes, an optical banknote detection sensor, which is a transmissive optical paper sheet detection sensor, might be used to detect banknotes transported along a transport path. Specifically, when the detection state of the optical banknote detection sensor changes from light transmission to light blocking, the leading end of the arrived banknote is detected. When the detection state of the optical banknote detection sensor changes from light blocking to light transmission, the trailing end of the banknote is detected. Light passes though the transparent part of the banknote, and thus the optical banknote detection sensor might erroneously detect the end of the banknote having the transparent part.

Patent Document 1 discloses a banknote handling device including means for detecting a transparent part of a banknote. The means for detecting the transparent part has a plurality of transmissive optical banknote detection sensors arranged in line in a direction orthogonal to the transport direction of the banknote. By comparing the detection results of the plurality of optical banknote detection sensors, it can be determined whether or not the banknote has a transparent part. If it has been determined that the banknote has a transparent part, the device disclosed in Patent Document 1 stops detecting the transparent part thereafter when detecting the banknote by the optical banknote detection sensors. Accordingly, erroneous detection of the end of the banknote is avoided.

Patent Document 2 discloses that the position of the transparent part of the banknote is specified based on an image of the banknote or the magnetic information of the banknote obtained by the recognition unit. The device disclosed in Patent Document 2 regards a portion excluding a transparent part in the entire banknote as a detection area of a sensor. Accordingly, erroneous detection and erroneous determination caused by detection of the transparent part are avoided.

Patent Document 3 discloses a configuration in which the optical axis of a transmissive optical banknote detection sensor is inclined without being orthogonal to the surface of the banknote. If the optical axis is inclined, part of the light is reflected on the surface and the rest passes through the surface in the transparent part of the banknote. The amount of transmitted light at the time of reception decreases by the amount of reflection of the part of the light. This makes it possible to determine that the light has passed through the transparent part of the banknote, and thus erroneous detection can be avoided.

Patent Document 4 discloses a transmissive optical banknote detection sensor having a configuration in which a polarizing plate is arranged on each of a light illumination side and a light reception side so that the polarization directions are orthogonal to each other. With this configuration, when the light is not blocked by the banknote, the light linearly polarized by the polarizing plate on the light illumination side reaches, as it is, the polarizing plate on the light reception side having an angle deviated by 90°. Accordingly, the pass of light is blocked by the polarizing plate on the light reception side. On the other hand, the light linearly polarized by the polarizing plate on the light illumination side is turned to non-polarized diffused light if passing through the transparent part of the banknote. Accordingly, light can be received through the polarizing plate on the light reception side. As such, the optical banknote detection sensor disclosed in Patent Document 4 includes the polarizing plates to detect the presence of the transparent part of the banknote and the position of the transparent part.

Patent Document 5 discloses a transmissive optical banknote detection sensor having a configuration in which based on the that the amount of light having passed through the transparent part of the banknote decreases, if the amount of the received light is less than 100%, it is determined that the light has passed through the transparent part of the banknote, and if the amount of the received light is 100%, it is determined that no banknote is detected between the banknotes. Patent Document 5 also supposes use of an optical paper sheet detection sensor outputting a non-linear output value with respect to an increase or decrease in the amount of received light, and then discloses a technique of a devised detection method in which it is accurately specified whether the received light is light having passed through the transparent part of the banknote or light passing between the banknotes.

Patent Document 6 discloses irradiating light or ultrasonic wave on the banknote and detecting the reflected wave of the light or ultrasonic wave reflected on the surface of the banknote in order to detect the banknote. Accordingly, even if the transparent part is present in the banknote, the avoidance of erroneous detection is attempted.

Patent Document 7 discloses a banknote handling device having a configuration in which the thickness of a banknote is detected. For the detection of the thickness, a pair of rollers facing each other are used. Specifically, the displacement of the rollers when the banknote passes between the pair of rollers to detect the banknote is detected. Accordingly, so-called a double feed failure or chain feed failure in which a plurality of banknotes are transported in an overlapping manner, and a failure in which a part of a banknote is folded are detected.

Similarly, Patent Document 8 also discloses a banknote thickness detection device. The thickness detection device disclosed in Patent Document 8 includes a reference roller extending in a direction orthogonal to the transport direction of the banknote, and a plurality of detection rollers arranged in line in an orthogonal direction and facing the reference roller. Each of the detection rollers is individually displaced depending on the thickness of the banknote passing between the reference roller and the detection roller such that the transport states such as double feed, chain feed, fold, skew of the banknote are detected.

Patent Document 9 discloses a banknote handling device in which a separating mechanism for separating and delivering stacked banknotes one by one includes a banknote thickness detection device to detect a transport state or pass of the banknote.

CITATION LIST

Patent Documents

Patent Document 1: International Patent Publication No. WO2009/75015

Patent Document 2: Japanese Unexamined Patent Publication No. 2013-142969

Patent Document 3: Japanese Unexamined Patent Publication No. 2015-95023

Patent Document 4: Japanese Unexamined Patent Publication No. 2014-29301

Patent Document 5: Japanese Unexamined Patent Publication No. 2015-138437

Patent Document 6: Japanese Unexamined Patent Publication No. 2014-182752

Patent Document 7: Japanese Patent No. 4086489

Patent Document 8: Japanese Patent No. 4819162

Patent Document 9: Japanese Patent No. 3191386

SUMMARY OF THE INVENTION

Technical Problem

The device disclosed in Patent Document 1 compares the detection result of each sensor to determine whether or not the banknote has a transparent part after the plurality of optical banknote detection sensors arranged in a direction orthogonal to the transport direction of the banknote have the light all blocked and detect the end of the banknote. Thus, when a transparent part in a window shape is present at a position other than the end of the banknote, such a transparent part can be detected. However, when a transparent part is present at the end of the banknote such as a five pound banknote of Clydesdale Bank in Scotland, the plurality of optical banknote detection sensors does not have the light all blocked, and thus the end of the banknote cannot be correctly detected. In the device disclosed in Patent Document 1, erroneous detection such as skew or break of such a banknote is caused. That is, the device disclosed in Patent Document 1 cannot detect the transparent part at the end of the banknote. If a banknote such as a Canadian banknote has a wide transparent part in the middle of a banknote, the plurality of optical banknote detection sensors detect light transmission at the transparent part substantially at the same time. Thus, the device disclosed in Patent Document 1 erroneously detects that the transparent part at the middle of the banknote is the trailing end of the banknote. The device disclosed in Patent Document 1 cannot detect the transparent part of such a banknote as well.

The device disclosed in Patent Document 1 further has a function for stopping the detection by the optical banknote detection sensors based on the information about the window-shaped transparent part stored in advance for each denomination after the denomination, direction, front/back, etc. of the transported polymeric banknotes are recognized. The device disclosed in Patent Document 2 determines the detection area of the sensor based on the information about the banknote acquired by the recognition unit. If the recognition information of the banknote is used for detection in this manner, the erroneous detection of the transparent part of the polymer banknote can be avoided.

However, recognition of a banknote is performed with a large, expensive image sensor, and thus in general, the recognition unit is installed in the middle of the transport path (e.g., a transport path connecting the depositing/dispensing unit to the storage unit) transporting the banknote. The recognition information can be used for banknotes that have passed through the recognition unit, but cannot be used for banknotes that does not have passed through the recognition unit. Thus, the configurations disclosed in Patent Document 1 and Patent Document 2 have a disadvantage that erroneous detection cannot be avoided for the banknotes that does not have passed through the recognition unit.

When a polymer banknote is fatigued, the light transmission part increases due to the wearing of the ink. Consequently, even if the detection is performed based on the recognition result, erroneous detection might occur.

In each of the configurations disclosed in Patent Documents 3 to 6, the detection is performed with utilization of the characteristics of a polymer banknote such that the erroneous detection of the polymer banknote having the transparent part is avoided. However, the detection accuracy depends on the characteristics of the polymer banknote, and it might be difficult to deal with polymer banknotes in various states.

For example, the detection accuracy might decrease if abrasion or scratching of the coating on the surface of the polymer banknote causes a fluctuation of the reflectance of light on the surface of a banknote, or if a hologram or white turbidity in the transparent part causes a fluctuation of the transmittance of light in the transparent part.

The detection accuracy also might change if the material of the polymer banknote is changed and thus the optical characteristics of the transparent part are changed.

If polymer banknotes of a plurality of countries are processed, or if the design of a polymer banknote is changed and then both the old banknote and the new banknote are processed, the state of the polymer banknotes is not constant. Thus, the detection accuracy might decreases.

Further, in recent years, the number of countries adopting polymer banknotes having transparent parts has increased, and the characteristics of polymer banknotes issued in the future are unpredictable. The banknote might be unable to be detected only by the existing optical banknote detection sensor that depends on the characteristics of the polymer banknotes. This applies not only to the optical banknote detection sensor but also to a sensor utilizing another wave such as ultrasonic wave. Due to these problems, if the identical banknote handling device is sold to countries all over the world, such a banknote handling device might be required to be significantly modified.

On the other hand, the thickness detection devices disclosed in Patent Documents 7 to 9 detect the thickness of the passing banknote and the front end and the rear end of the banknote to detect the transport states such as double feed, chain feed, fold, etc. of the banknote. Further, the thickness detection device of Patent Document 9 detects the front ends and the rear ends of the banknotes to detect passes of the banknote and count the banknotes. The thickness detection devices of Patent Documents 7 to 9 can correctly handle a polymer banknote even having a transparent part.

However, even if the thickness detection device itself can be operated correctly, it is typical use an optical paper sheet detection sensor on the upstream side or the downstream side thereof. Thus, similar to Patent Document 1, erroneous detection of the end of the banknote occurs depending on the transparent part of the polymer banknote. Patent Documents 7 to 9 do not disclose solutions to this erroneous detection.

The handling of banknotes contains not only the pass detection and the counting but also various types of handling. The handling contains a handling for determining the start timing of the handling based on the time when the optical banknote detection sensor detects the end of the banknote. For example, in acquisition of a banknote image, if the polymer banknote has a transparent part at the leading end so that the detection of the leading end of the banknote is delayed, the acquisition start of the banknote image is also delayed. Then, the image of the leading end of the banknote cannot be acquired correctly.

The above problem is not limited to the banknote having the transparent part, and might occur in the same way even in a device for handling securities such as gift certificates or checks having transparent parts.

In view of the foregoing, it is an object of the technique disclosed herein to detect an end of a paper sheet such as a polymer banknote or security having a transparent part without erroneous detection.

Solution to the Problem

A paper sheet handling device disclosed herein includes a paper sheet detection device arranged on a transport path for transporting a paper sheet and configured to detect the paper sheet, and a handling unit configured to perform handling related to the paper sheet based on the time when the paper sheet detection device detects an end of the paper sheet.

The paper sheet detection device includes a mechanical detection sensor including at least a pair of rolling bodies which face each other and between which the paper sheet passes, and a detection unit detecting a displacement of the rolling body when the paper sheet passes between the pair of rolling bodies facing each other in order to detect the end of the paper sheet.

According to this configuration, when the paper sheet passes between the rolling bodies facing each other, the rolling body displaces by the thickness of the paper sheet. The detection unit detect the displacement of the rolling body such that the mechanical detection sensor can detect the end of the paper sheet. The mechanical detection sensor of this configuration can accurately detect the end of the paper sheet regardless of whether or not the paper sheet has the transparent part. Thus, the handling unit can perform handling related to the paper sheet based on the time when the end of the paper sheet is accurately detected, and thus is prevented from performing handling based on the time when erroneous detection is done.

Here, "the end of the paper sheet" is either one of or both of the leading end and the trailing end of the transported paper sheet. The handling related to the paper sheet may be performed based on the time when the paper sheet detection device detects the leading end of the paper sheet, and the handling related to the paper sheet may be performed based on the time when the paper sheet detection device detects the trailing end of the paper sheet. The handling related to the paper sheet may be performed based on the time when the paper sheet detection device detects the leading end and trailing end of the paper sheet.

The handling unit may be an image acquisition unit disposed downstream of the mechanical detection sensor in a transport direction in the transport path, and configured to acquire an image of the paper sheet, and the image acquisition unit may acquire the image of the paper sheet based on the time when the mechanical detection sensor detects the end of the paper sheet.

The image acquisition unit acquires the image of the paper sheet based on the time when the mechanical detection sensor detects the end of the paper sheet such that the image of the paper sheet can be acquired appropriately.

The handling unit may be a thickness detection unit disposed downstream of the mechanical detection sensor in the transport direction in the transport path, and configured to detect a thickness of the paper sheet, and the thickness detection unit may detect the thickness of the paper sheet based on the time when the mechanical detection sensor detects the end of the paper sheet.

The thickness detection unit detects the thickness of the paper sheet based on the time when the mechanical detection sensor detects the end of the paper sheet such that the thickness of the transported paper sheet can be detected appropriately. The mechanical detection sensor substantially detects the thickness of the paper sheet. In this configuration, the mechanical detection sensor detects the thickness of the paper sheet to detect the end of the transported paper sheet, and the thickness detection unit detects the thickness of the paper sheet to accurately detect double feed, chain feed, folding, fold, etc. of the paper sheet.

The handling unit may be a magnetic detection unit disposed downstream of the mechanical detection sensor in the transport direction in the transport path, and configured to detect magnetic information of the paper sheet, and the magnetic detection unit may detect the magnetic information of the paper sheet based on the time when the mechanical detection sensor detects the end of the paper sheet.

The magnetic detection unit detects the magnetic information of the paper sheet based on the time when the mechanical detection sensor detects the end of the paper sheet such that the magnetic information of the transported paper sheet can be detected appropriately.

The handling unit may be a diversion unit disposed downstream of the mechanical detection sensor in the transport direction in the transport path, and configured to switch a destination of the paper sheet, and the diversion unit may switch the destination of the paper sheet based on the time when the mechanical detection sensor detects the end of the paper sheet.

The diversion unit switches the destination of the paper sheet based on the time when the mechanical detection sensor detects the end of the paper sheet such that the paper sheet can be transported smoothly.

The paper sheet detection device may further include an optical detection sensor that detects the paper sheet based on light irradiated toward the paper sheet, and each of the mechanical detection sensor and the optical detection sensor may be disposed on the transport path, and detect the paper sheet.

The combination of the mechanical detection sensor and the optical detection sensor enables an appropriate detection of the end of the paper sheet even having the transparent part. The paper sheet detection device is required to be disposed on a large number of places of the transport path, but an inexpensive optical detection sensor can be used as appropriate to reduce the cost.

The mechanical detection sensor may be arranged upstream of the optical detection sensor in the transport direction, and the paper sheet detection device may correct a detection result of the optical detection sensor based on a detection result of the mechanical detection sensor.

The optical detection sensor might erroneously detect the end of the banknote having the transparent part. The detection result of the optical detection sensor is corrected based on the detection result of the mechanical detection sensor such that erroneous detection of the optical detection sensor can be prevented.

The paper sheet detection device may detect at least a presence or absence of a transparent part of the paper sheet, based on the detection result of the mechanical detection sensor and the detection result of the optical detection sensor.

The comparison between the detection result of the mechanical detection sensor and the detection result of the optical detection sensor enables determination of at least the presence or absence of the transparent part of the paper sheet. The position of the transparent part in the paper sheet can be also determined.

The mechanical detection sensor may be arranged upstream of the optical detection sensor in the transport direction, and the handling unit may perform handling related to the paper sheet based on the time when the optical detection sensor detects the end of the paper sheet.

The handling unit may be a diversion unit disposed downstream of the optical detection sensor in the transport direction in the transport path, and configured to switch a destination of the paper sheet, and the diversion unit may switch the destination of the paper sheet based on the time when the optical detection sensor detects the end of the paper sheet.

The paper sheet handling method disclosed herein includes detecting a displacement of a pair of rolling bodies facing each other and disposed on a transport path transporting a paper sheet when the paper sheet passes between the pair of rolling bodies, and performing handling related to the paper sheet based on the detection of the displacement of the rolling body.

The thickness of the paper sheet is detected by displacement of the rolling body, and then the end of the paper sheet is detected. Thus, the end of the paper sheet can be detected accurately regardless of the presence or absence of the transparent part of the paper sheet. The handling related to the paper sheet is performed based on the accurate detection of the end of the paper sheet, and thus the handling based on erroneous detection is prevented.

Advantages of the Invention

As described above, the technique disclosed herein enables accurate detection of the end of the paper sheet having the transparent part. The technique disclosed herein also enables appropriate handling related to the paper sheet based on accurate detection of the end of the paper sheet.

DESCRIPTION OF EMBODIMENTS

Embodiments of a paper sheet handling device and a paper sheet handling method will be described below with reference to the drawings. The techniques of the present disclosure will be described below as an example of a banknote handling device, which is one of the paper sheet handling devices. Note that the following description is an example of the paper sheet handling device and the paper sheet handling method.

Here, a banknote to be handled by a banknote handling device 1 will be described. The banknote to be handled is a polymer banknote having a transparent part. Note that the banknote handling device 1 can also handle banknotes without a transparent part, for example, banknotes made of paper.

Figure 7:
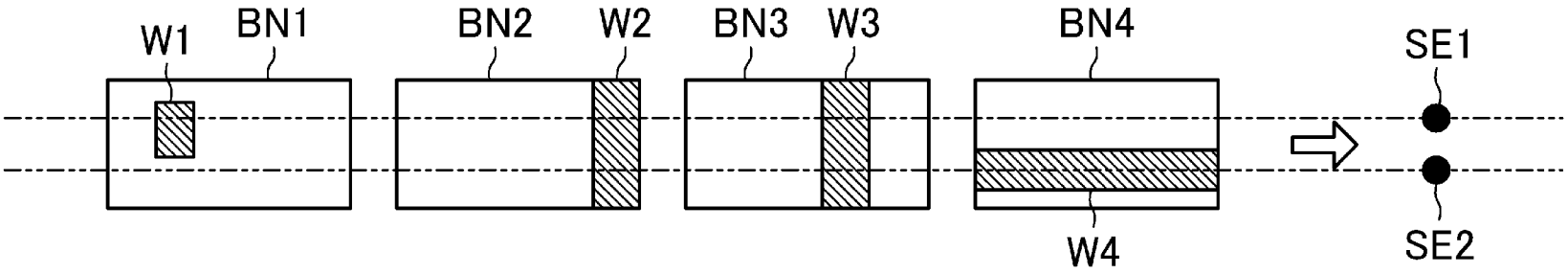
FIG. 7 illustrates banknotes having transparent parts.

FIG. 7 illustrates banknotes to be handled. First, a banknote BN1 shown at the left end has a transparent part W1 formed in a window shape. Here, suppose that the banknote handling device includes two optical detection sensors SE1, SE2 separately arranged in the direction orthogonal to the transport direction (the direction from left to right in FIG. 7) to detect passes of banknotes. When the banknote BN1 shown in FIG. 7 passes through the two optical detection sensors SE1, SE2, the optical detection sensor SE1 on the one hand detects light transmission at the transparent part W1. In contrast, the optical detection sensor SE2 does not detect light transmission during a pass of the banknote BN1. This causes a difference in the detection signals between the two optical detection sensors SE1, SE2. The optical detection sensors SE1, SE2 may erroneously detect this difference as a transport failure.

A banknote BN2 shown in the second from the left has a transparent part W2 at one end of the long edge direction. For example, a five pound banknote of Clydesdale Bank of Scotland is similar to this banknote BN2. When the optical detection sensors SE1, SE2 attempt to detect a pass of the banknote BN2, the transparent part W2 is translucent. Thus, both of the two optical detection sensors SE1, SE2 cannot detect the end part of the banknote BN2. The two optical detection sensors SE1, SE2 can detect only a part of the banknote BN2 behind the transparent part W2. The optical detection sensors SE1, SE2 cannot detect the end part of the banknote BN2. If a banknote has a transparent part at the other end of the long edge direction in contrast to the illustrated example, the optical detection sensors SE1, SE2 also cannot detect the other end of the banknote.

A banknote BN3 shown in the third from the left has a transparent part W3 provided near the middle thereof in the long edge direction and extending in the short edge direction. For example, Canadian banknotes are similar to this banknote BN3. Both of the two optical detection sensors SE1, SE2 detect the banknote BN3 by light blocking, then detect light transmission in the transparent part W3, and thus detect the transparent part W3 of the banknote as an end part of the banknote. The two optical detection sensors SE1, SE2 can also detect a part of the banknote behind the transparent part W3 by light blocking, and may erroneously detect this part as a next banknote.

A banknote BN4 shown in the fourth from the left has a transparent part W4 extending in a band shape from end to end in the long edge direction. The optical detection sensor SE2 of the two optical detection sensors SE1, SE2 is arranged in a position corresponding to the transparent part W4. Thus, the optical detection sensor SE2 cannot detect the banknote BN4. The optical detection sensor SE1 on the other hand detects the banknote BN4. The optical detection sensors SE1, SE2 erroneously detect this banknote BN4 as a transport failure.

Note that FIG. 7 illustrates an example of short edge feeding of the banknotes. Even in the case of long edge feeding of the banknote having a transparent part, the optical detection sensors may erroneously detect the banknote.

The banknote handling device 1 shown below is configured to be able to reliably and accurately detect passes of various banknotes having transparent parts.

(General Configuration of Banknote Handling Device)

Figure 1:
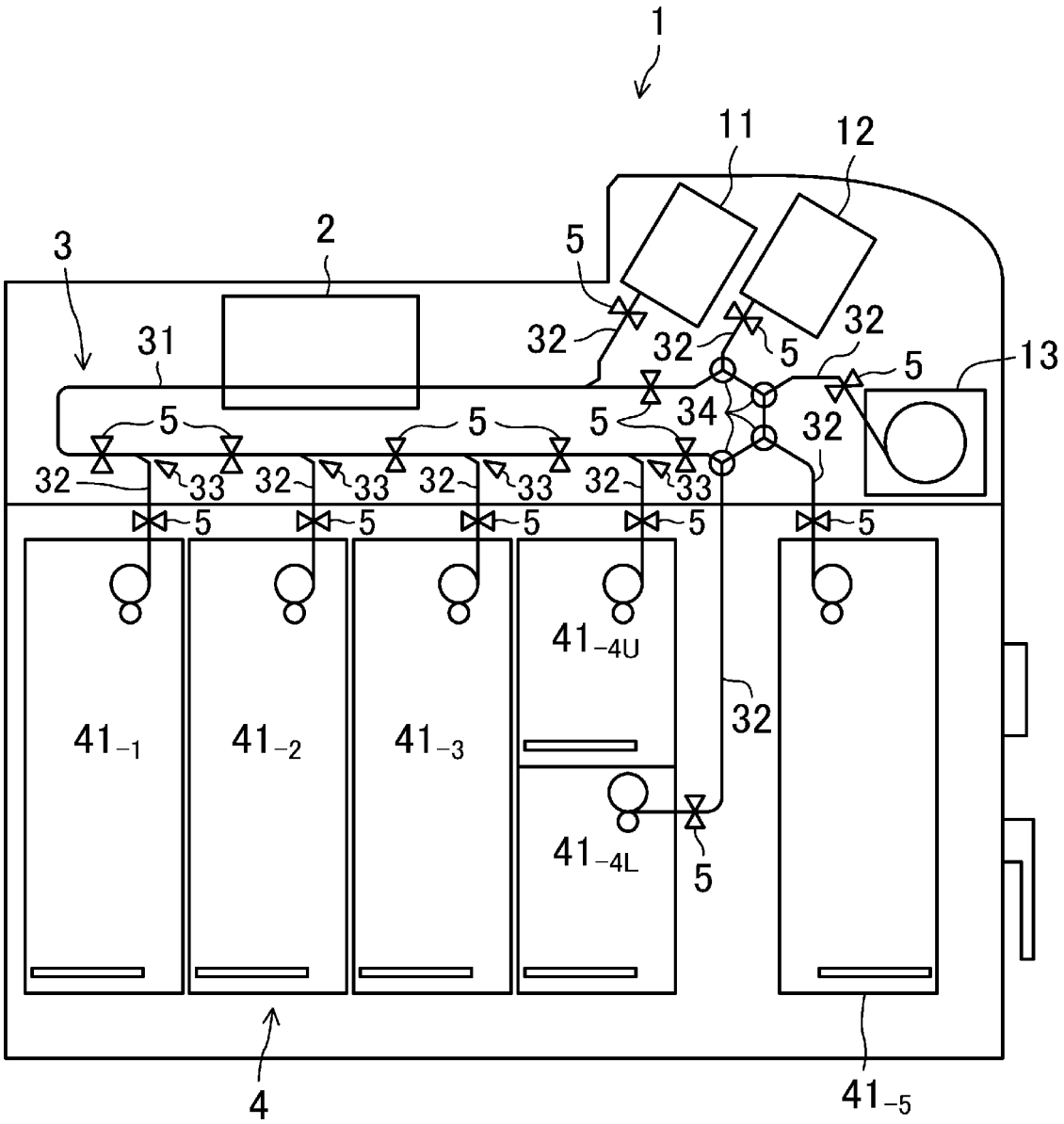
FIG. 1 is a schematic view of an entire configuration of a banknote handling device.

FIG. 1 conceptually illustrates a configuration of the banknote handling device 1. The banknote handling device 1 is used in, e.g., branches of a bank or any other financial institutions. The banknote handling device 1 shown in FIG. 1 is a banknote depositing and dispensing machine which performs depositing and dispensing of banknotes. Note that the banknote handling device 1 is not limited to a banknote depositing and dispensing machine. The banknote handling device 1 may be any apparatus such as a banknote depositing machine, a banknote dispensing machine, or a banknote processing machine, provided with a transport path for transporting banknotes.

The banknote handling device 1 includes a depositing unit 11, a dispensing unit 12, a recognition unit 2, an escrow unit 13, a transport unit 3 having a transport path 31, and a storage unit 4 for storing the banknotes.

Although not shown in detail, the depositing unit 11 has an inlet through which the banknotes are placed. The inlet opens at a top surface of the banknote handling device 1. For example, in a depositing process, the banknotes are placed in the inlet. The inlet holds two or more banknotes at a time.

The dispensing unit 12 has an outlet which opens at the top surface of the banknote handling device 1. For example, in a dispensing process, the banknotes come to the outlet. The outlet holds two or more banknotes at a time.

The recognition unit 2 is provided in the middle of the transport path 31 of the banknote. The recognition unit 2 is configured to recognize at least a denomination of each of the banknotes being transported through the transport path 31, and whether each of the banknotes is genuine or not. The recognition unit 2 may also be configured to recognize whether the banknotes are fit or unfit. The configuration of the recognition unit 2 will be described later.

The escrow unit 13 is a storage unit which temporarily stores banknotes rejected in the dispensing process, for example. The escrow unit 13 also functions as a storage unit which temporarily stores banknotes taken in the depositing process, for example. In the illustrated example, the escrow unit 13 is a storage unit winding banknotes between tapes.

In the example shown in FIG. 1, the storage unit 4 includes five storing cassettes, namely, first to fifth storing cassettes $41_{-1}$ to $41_{-5}$. Note that, in the following description, reference numeral "41" will collectively indicate the first to fifth storing cassettes. When the first to fifth storing cassettes need to be distinguished from each other, reference numerals "$41_{-1}$," "$41_{-2}$," "$41_{-3}$," "$41_{-4}$," and "$41_{-5}$" will be given to them. Each of the first to fifth storing cassettes $41_{-1}$ to $41_{-5}$ is detachably attached to the banknote handling device 1.

The storing cassette 41 stores the banknotes therein stacked in the vertical direction. The storing cassette 41 has a passage opening which opens at the top surface thereof and which the banknotes pass through. The storing cassette 41 is configured to store banknotes sent therein through the passage opening, and to be able to feed the stored banknotes outside through the opening.

Note that the interior of the fourth storing cassette $41_{-4}$ is horizontally divided in two spaces as illustrated in FIG. 1. The upper space of the fourth storing cassette $41_{-4}$ (the upper fourth storing cassette $41_{-4U}$) is connected to the outside through the passage opening formed at the top surface of the casing. The lower space of the fourth storing cassette $41_{-4}$ (the lower fourth storing cassette $41_{-4L}$) is connected to the outside through a passage opening formed on a side surface of the casing.

The transport unit 3 includes the looped transport path 31. Each of the depositing unit 11, the dispensing unit 12, the escrow unit 13, and the storing cassettes 41 is connected to the transport path 31 via a connection path 32. A diversion unit 33, 34 switching destinations of the banknotes is disposed at a connection part between the transport path 31 and each of the connection paths 32.

On the transport path 31 and the connection path 32, a tracking sensor 5 detecting passes of banknotes is disposed. The tracking sensors 5 in the example of FIG. 1 are disposed in the following locations. Specifically, the locations include the vicinity of the depositing unit 11, the vicinity of the dispensing unit 12, the vicinity of the escrow unit 13, the vicinity of each of the storing cassettes 41, the vicinity of the diversion units 33, 34 (i.e., upstream each unit of the transport direction of banknotes). The tracking sensors 5 may also be disposed at locations other than the locations shown in FIG. 1. To track the banknotes on the transport path, the tracking sensors 5 are preferably disposed at intervals shorter than the length of the banknotes. The tracking sensors 5 are not necessarily disposed at the locations shown in FIG. 1. The configuration of the tracking sensor 5 will be described later.

Figure 2:
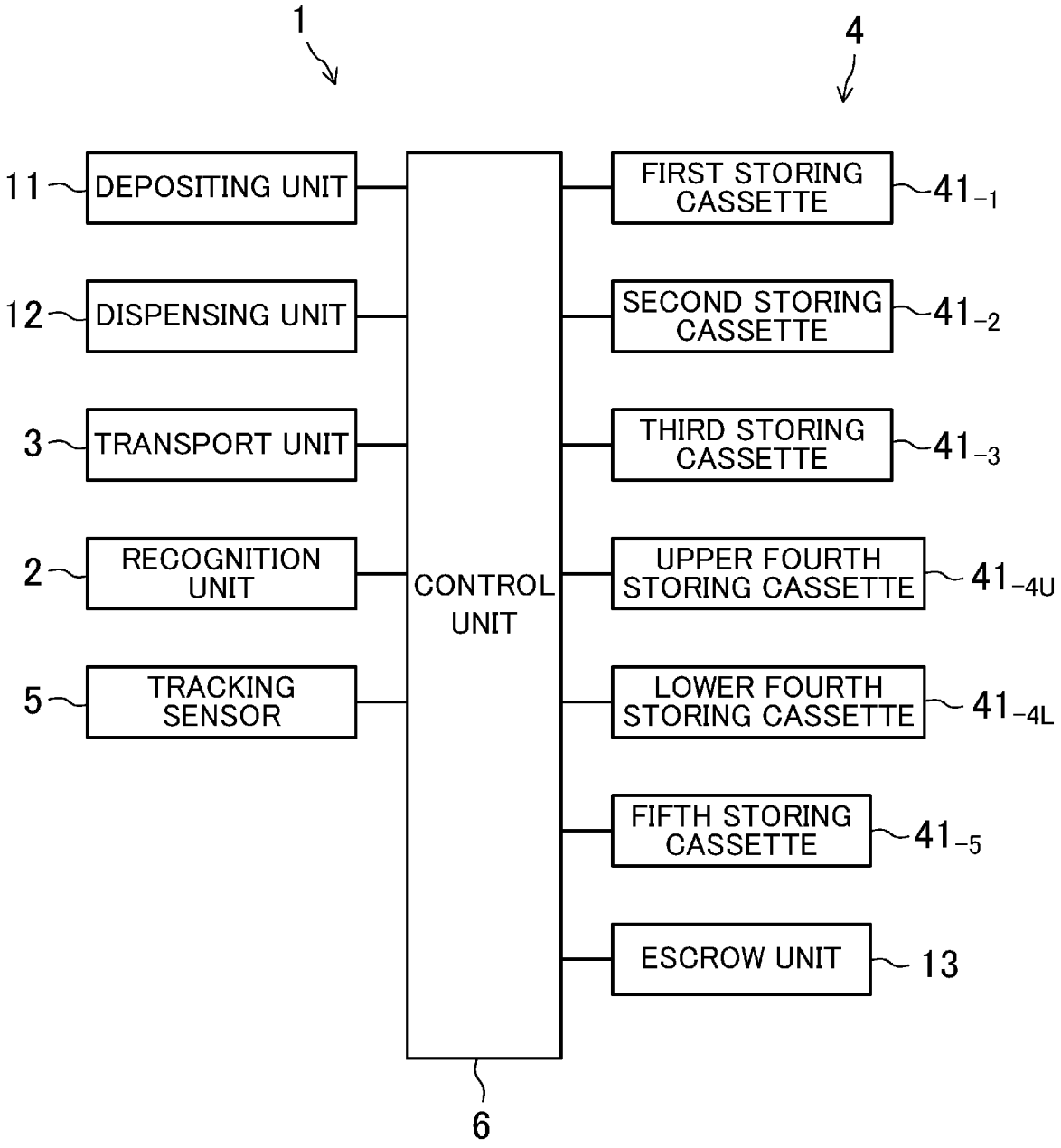
FIG. 2 is a block diagram of a configuration of control of the banknote handling device.

FIG. 2 illustrates a configuration related to the operation control of the banknote handling device 1. The banknote handling device 1 includes a control unit 6 based on, e.g., a known microcomputer. The control unit 6 is connected to the depositing unit 11, the dispensing unit 12, the escrow unit 13, recognition unit 2, the transport unit 3 including the diversion units 33, 34, and the storage unit 4 including the first to fifth storing cassettes 41 so as to be able to transmit and receive signals. The control unit 6 is connected to each of the tracking sensors 5. The tracking sensor 5 outputs a detection signal to the control unit 6 when detecting a pass of the banknote. Based on the signals from the units 11 to 13, 2, 3, and 4 and the tracking sensors 5, the control unit 6 controls the transport unit 3 including the diversion units 33, 34 to send the banknotes to predetermined destinations.

In the depositing process, the banknote handling device 1 having the above-described configuration operates in the following manner. Specifically, banknotes to be deposited are placed in the inlet. The depositing unit 11 feeds the banknotes in the inlet one by one. The transport unit 3 transports the banknotes to the recognition unit 2. The recognition unit 2 recognizes denomination and authentication of the banknotes. The transport unit 3 transports the banknotes to the escrow unit 13. The escrow unit 13 temporarily stores the deposited banknotes. The transport unit 3 transports the banknotes from the escrow unit 13 to a predetermined storing cassette 41 based on the recognition results. The transport unit 3 may transport the banknotes to the dispensing unit 12. The depositing process ends when the banknotes in the inlet are all fed.

In the dispensing process, the banknote handling device 1 having the above-described configuration operates in the following manner. Specifically, the banknotes to be dispensed to the outlet are fed from the predetermined storing cassette 41. The transport unit 3 transports the banknotes to the recognition unit 2. The recognition unit 2 recognizes the banknotes. The transport unit 3 dispenses fit banknotes to the outlet. The transport unit 3 transports rejected banknotes to the escrow unit 13. The escrow unit 13 stores the rejected banknotes. The dispensing process ends when a designated amount of banknotes is dispensed to the outlet. The transport unit 3 also transports the rejected banknotes stored in the escrow unit 13 to a predetermined storing cassette 41.

(Configuration of Tracking Sensor)

Figure 3A:
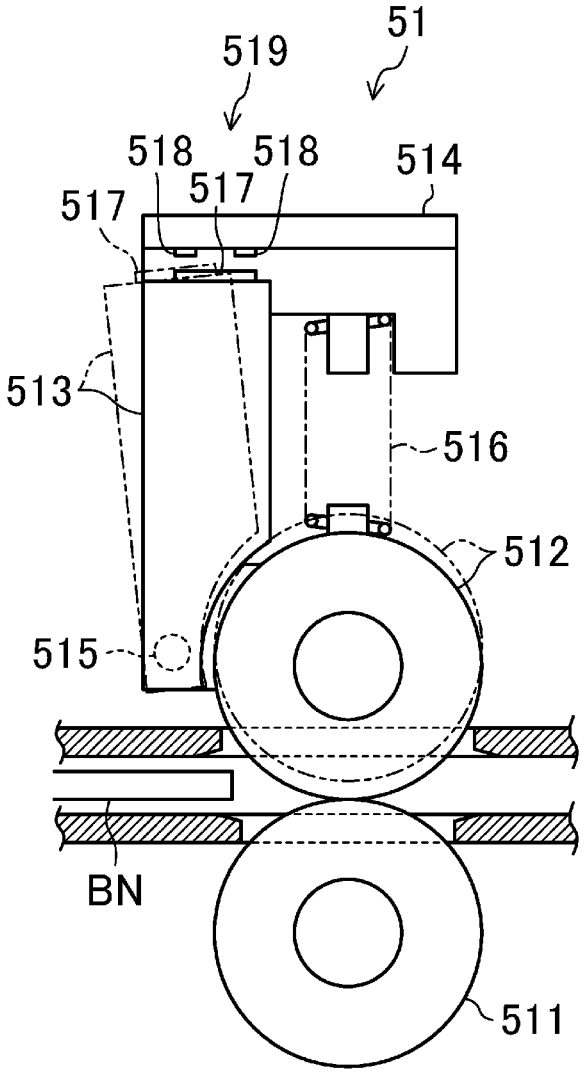
FIG. 3A is a front view of a configuration of a mechanical detection sensor.
Figure 3B:
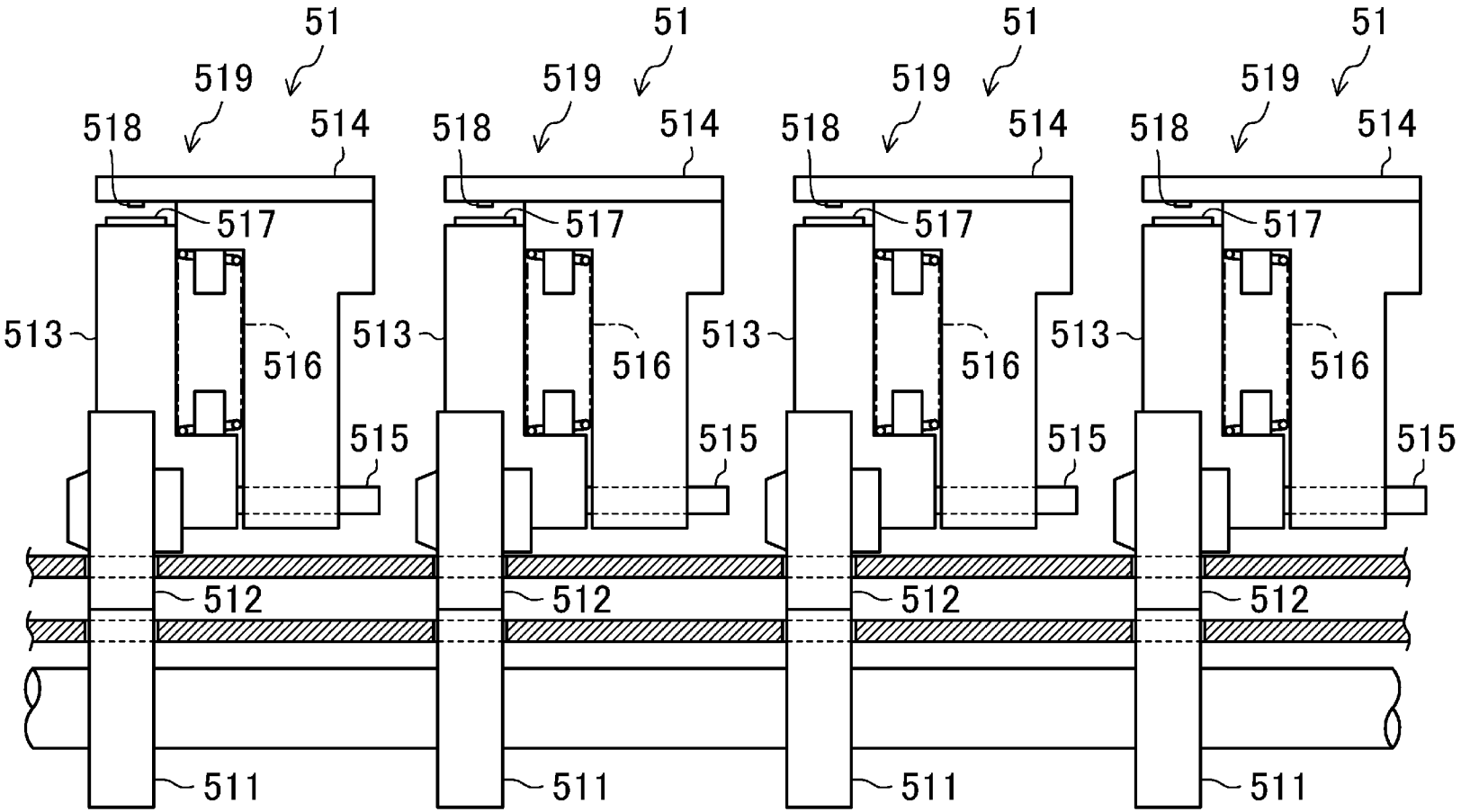
FIG. 3B is a side view of a configuration of the mechanical detection sensor.

FIGS. 3A and 3B illustrate the configuration of a mechanical detection sensor 51 as one example of the tracking sensor 5. The mechanical detection sensors 51 are disposed at the above-described positions on the transport path 31 and the connection paths 32 instead of typical optical detection sensors.

The mechanical detection sensor 51 includes a pair of rollers 511, 512 facing each other. The banknote BN passes between the pair of rollers 511, 512. The pair of rollers 511, 512 are composed of a driving roller 511 and a driven roller 512. The mechanical detection sensor 51 has a function as a pinch roller transporting the banknote BN along the transport path 31 and the connection path 32. As illustrated in FIG. 3B, a plurality of mechanical detection sensors 51 functioning as pinch rollers as well are disposed at installation positions on the transport path 31 and the connection paths 32 in a direction orthogonal to the transport direction of the banknote BN. Note that, unlike the example of FIG. 3B, at least one pinch roller among the plurality of pinch rollers disposed side by side in the direction orthogonal to the transport direction of the banknote BN may have a detection unit 519 described later to serve as the mechanical detection sensor 51.

The driven roller 512 is rotatably supported by the roller support 513. The roller support 513 is pivotally supported around a pivotal shaft 515 with respect to a sensor body 514. The pivotal shaft 515, in the example shown in FIGS. 3A and 3B, is parallel to a rotation shaft of the driven roller 512, and is orthogonal to the transport direction of the banknote BN.

A compression spring 516 is disposed between the roller support 513 and the sensor body 514. The compression spring 516 biases the roller support 513 in a direction to press the driven roller 512 against the driving roller 511, whereas the driven roller 512 allows the roller support 513 to pivot in a direction to move away from the driving roller 511.

The roller support 513 has an upper end to which a magnet 517 is attached. As will be described later, when the banknote BN passes between the pair of rollers 511, 512, the driven roller 512 is displaced by the thickness of the banknote BN in a direction to move away from the driving roller 511 while the roller support 513 pivots.

This allows the magnet 517 attached to the upper end of the roller support 513 to change its position in the substantially horizontal direction (see the two-dot chain line in FIG. 3A).

Two Hall elements 518 are attached to the sensor body 514 so as to face the magnet 517 attached to the upper end portion of the roller support 513. The Hall elements 518 are configured to detect a magnetic field formed by the magnet 517. As described above, when the magnet 517 moves in the horizontal direction, a voltage corresponding to the magnetic field varying depending on the movement is output. The output voltage is compared, by a comparator mounted on the sensor body 514, with a reference voltage corresponding to a threshold value for determining whether the banknote BN is detected or not, and is output as a detection signal indicating detection or non-detection of the banknote BN. As such, the mechanical detection sensor 51 detects a pass of the banknote BN by displacement of the driven roller 512, and outputs the detection signal to the control unit 6. The magnet 517 attached to the roller support 513 and the Hall elements 518 attached to the sensor body 514 constitute a detection unit 519 detecting the banknote BN.

As described above, the mechanical detection sensor 51 detects a pass of the banknote BN by displacement of the driven roller 512. That is, the detection by the mechanical detection sensor 51 is equivalent to detection of the thickness of the banknote BN. Thus, as illustrated in FIG. 7, the passes of the banknotes BN, namely the banknotes BN1 to BN4 having the transparent parts W1 to W4, respectively, as well can be reliably and accurately detected without the erroneous detection which might occur in the optical detection sensors SE1, SE2 as described above. The control unit 6 controls the diversion units 33, 34 based on the detection signal from the mechanical detection sensor 51 to accurately transport the banknote BN to a desired transport destination. The control of the diversion units 33, 34 based on the detection signal from the mechanical detection sensor 51 will be described later.

The optical sensor might causes erroneous detection due to, e.g., dust etc. In contrast, the mechanical detection sensor 51 does not use optical means, and such erroneous detection is avoided. The detection accuracy of the optical detection sensor is affected by a temperature fluctuation, but the detection accuracy of the mechanical detection sensor 51 is advantageously less affected by such a temperature fluctuation.

The mechanical detection sensor 51 detects the thickness of the banknote BN as described above. In this respect, the mechanical detection sensor 51 is similar to a typical thickness detection unit that detects the thickness of the banknote BN to detect transport failures such as double feed, chain feed, a fold, etc., and to detect that a tape etc. is stuck on the banknote BN. Note that the mechanical detection sensor 51 merely detects a pass of the banknote BN, and the detection accuracy of the thickness is relatively low. The thickness of one banknote is about 100 μm, and the detection accuracy of the mechanical detection sensor 51 is also the accuracy corresponding thereto. In contrast, the thickness detection unit described later also detects the thickness of the tape etc. stuck on the banknote BN, and requires the detection accuracy of about 10 μm. The mechanical detection sensor 51 detects the thickness of one or less banknote BN, whereas the thickness detection unit detects the thickness of one or more banknote BN.

The mechanical detection sensor 51 having detection accuracy lower than that of the thickness detection unit has a simple and compact structure. Thus, the mechanical detection sensor 51 can be constructed at low cost, though it is not as low as the cost of the optical detection sensor. As described above, a large number of tracking sensors 5 are disposed in the transport path 31 and the connection path 32 of the banknote handling device 1. All of these tracking sensors 5 can be constituted by the mechanical detection sensor 51 described above.

Note that the configuration of the mechanical detection sensor is not limited to the examples illustrated in FIGS. 3A and 3B. For example, the mechanical detection sensor may include publicly known pinch rollers having various configurations, with a detection unit incorporated into the pinch rollers.

The detection of displacement of the driven roller 512 is not limited to the method using the magnet 517 and the Hall elements 518 as long as the displacement can be measured. For example, a magnetoresistive element, a combination of a light source and a light receiving element, or a proximity sensor may be used. It is possible to compare an output value, which is a resistance value output from these sensors, or an electric signal such as a voltage, a current, etc., with a threshold value to detect the banknote BN.

The process of converting the output value of the sensor into the detection signal can be conducted not only by the sensor body but also by another handling unit. For example, in the recognition unit described later, a comparator may compare a reference value corresponding to the threshold value with the output value, or may compare the A/D converted output value with the threshold value to convert the output value into the detection signal.

Figure 4A:
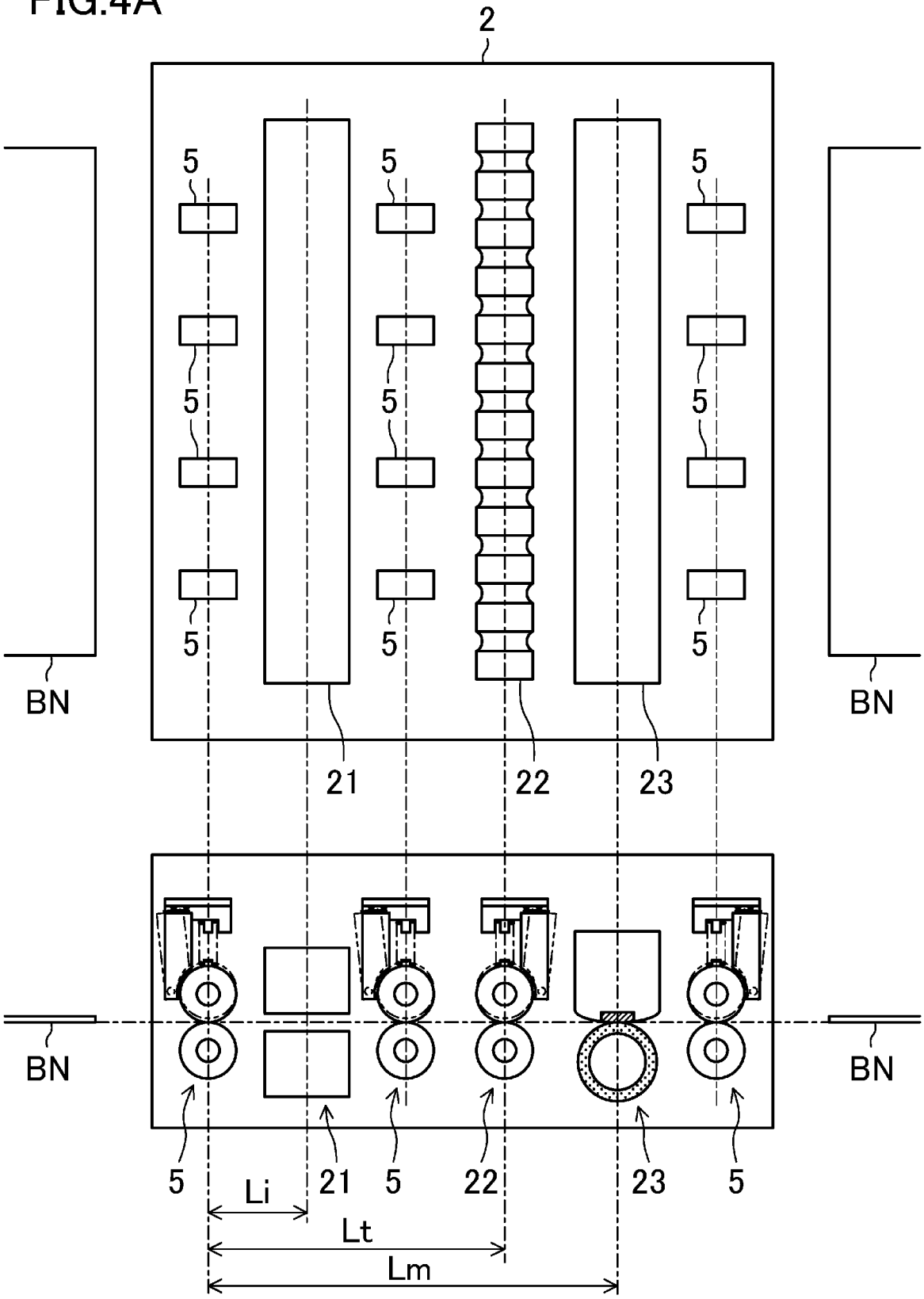
FIG. 4A An upper part of FIG. 4A is a schematic plan view of a configuration of a recognition unit, and a lower part of FIG. 4A is a schematic side view of the configuration of the recognition unit.

(Configuration of Recognition Unit) FIG. 4A illustrates a configuration of the recognition unit 2. The recognition unit 2 is composed of an upper unit and a lower unit sandwiching the transport path of the banknote BN. The upper part of FIG. 4A is a plan view of the lower unit of the recognition unit 2 as viewed from above. The recognition unit 2 includes an image acquisition unit 21 acquiring an image of the banknote BN, a thickness detection unit 22 detecting the thickness of the banknote BN, and a magnetic detection unit 23 acquiring magnetic information of the banknote BN.

The image acquisition unit 21 includes CCD or CMOS line sensors provided vertically to acquire images of both sides of the banknote BN. As illustrated in the lower part of FIG. 4A, the thickness detection unit 22 has a pair of rollers through which the banknote BN passes, and detects the thickness of the banknote BN based on the displacement of the rollers. The thickness detection unit 22 has substantially the same configuration as that of the mechanical detection sensor 51, but the driving roller thereof is a metal rod, and has high rigidity and high detection accuracy. The thickness detection unit 22 detects transport failures such as double feed, chain feed, a fold, etc., and detects that a tape etc. is stuck on the banknote BN. The magnetic detection unit 23 includes a magnetic line sensor having magnetic sensors arranged in line and a roller pressing the banknote to the magnetic line sensor to acquire a magnetic image of the banknote, the magnetic line sensor and the roller facing each other.

The image acquisition unit 21, the thickness detection unit 22, and the magnetic detection unit 23 are arranged with predetermined intervals in the transport direction of the banknote BN (the lateral direction in the page of FIG. 4A). Note that the banknote BN may be transported from left to right in the page of FIG. 4A, or may be transported from right to left in the page.

The recognition unit 2 has the tracking sensors 5. The tracking sensors 5 are disposed at both sides along the transport direction of the banknote BN so as to sandwich the image acquisition unit 21, and also disposed on the side opposite to the thickness detection unit 22 with respect to the magnetic detection unit 23. At each position, the plurality of tracking sensors 5 (the four tracking sensors in the illustrated example) are arranged in the respective positions in line at predetermined intervals in the direction orthogonal to the transport direction. Suppose that the banknote BN is transported from left to right in the page of FIG. 4A. A distance from the detection position of the most upstream passage sensors 5 to the acquisition position of the image acquisition unit 21 is set to Li. A distance from the detection position of the most upstream passage sensors 5 to the detection position of the thickness detection unit 22 is set to Lt. A distance from the detection position of the most upstream passage sensors 5 to the detection position of the magnetic detection unit 23 is set to Lm.

The image acquisition unit 21 acquires an image of the banknote BN based on the time when the tracking sensor 5 located upstream in the transport direction detects the end of the banknote BN (that is, based on detection of the leading end of the banknote BN). That is, the image acquisition unit 21 starts acquiring the image of the banknote BN based on the time when the tracking sensor 5 detects the end of the banknote BN.

Similarly, the thickness detection unit 22 detects the thickness of the banknote BN based on the time when the tracking sensor 5 located upstream in the transport direction detects the end of the banknote BN. The magnetic detection unit 23 detects the magnetic information of the banknote BN based on the time when the tracking sensor 5 located upstream in the transport direction detects the end of the banknote BN.

Figure 4B:
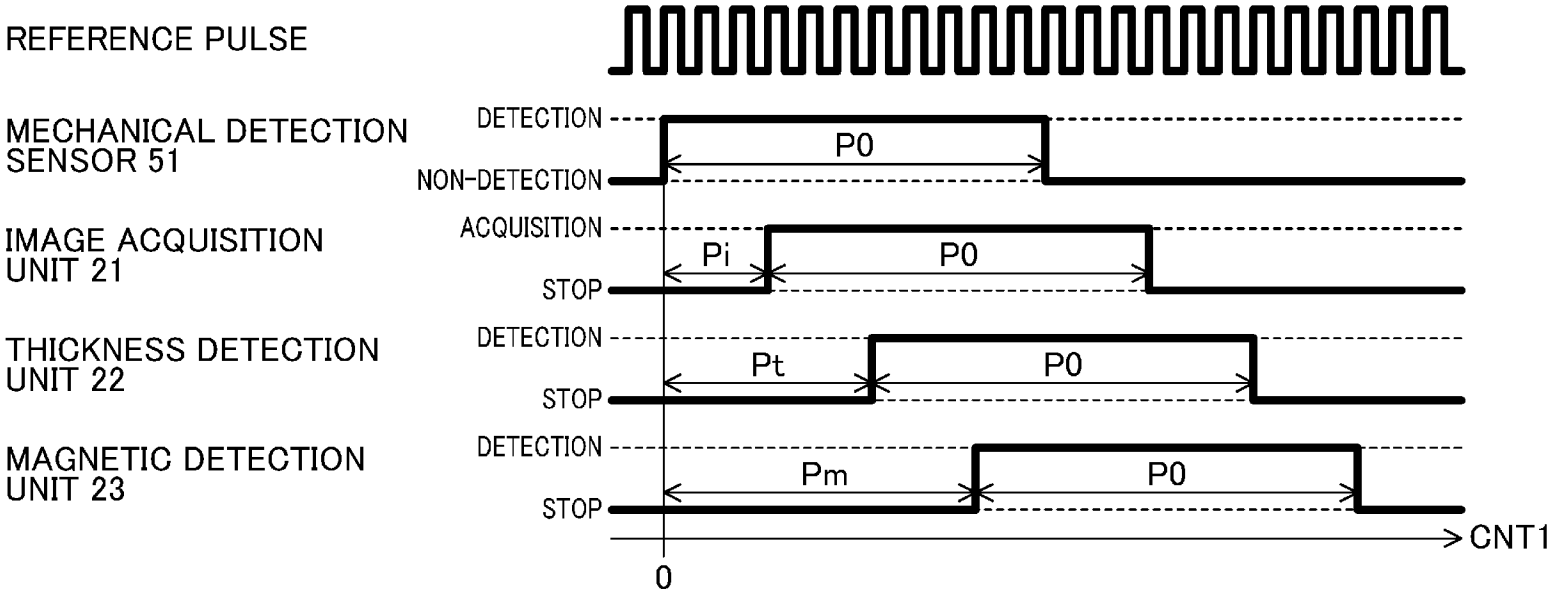
FIG. 4B illustrates a configuration of an image acquisition, thickness detection, and magnetic detection of a banknote in the recognition unit based on the detection by mechanical detection sensor.

FIG. 4B is a diagram for describing operations of the image acquisition unit 21, the thickness detection unit 22, and the magnetic detection unit 23 in the recognition unit 2 having the configuration described above. FIG. 4B shows operation timing of each unit 21, 22, 23, supposing that the banknote BN is transported from left to right in the page of FIG. 4A.

The top of FIG. 4B shows a reference pulse. The reference pulse uses an output pulse of a rotary encoder attached to the driving roller of the transport unit 3. The number of reference pulses is proportional to a transport distance of the banknote BN. Note that, if the transport speed of the banknote BN is constant, the following operations can be conducted with reference to the actual time instead of using the reference pulse, but the operations are more advantageously conducted with reference to the time of the above-described reference pulses to accurately detect the position of the banknote BN.

The horizontal axis of FIG. 4B shows a count value CNT1 of the reference pulse. Note that the reference pulse shown herein is rougher than the actual reference pulse for the sake of clear understanding (that is, the actual reference pulse includes a large number of pulses).

The second from the top in FIG. 4B shows a detection signal of the mechanical detection sensor 51 located at the uppermost position in the transport direction. When the driven roller 512 of the mechanical detection sensor 51 is displaced beyond a preset threshold value, the mechanical detection sensor 51 detects the banknote BN. As illustrated in FIG. 4B, when the mechanical detection sensor 51 detects the banknote BN, the count value CNT1 of the reference pulse is reset, and the count of pulses is started (see "0" on the horizontal axis in FIG. 4B). A count value P0 when the mechanical detection sensor 51 is in non-detection corresponds to a length L0 of the banknote BN.

The third from the top in FIG. 4B shows image acquisition timing of the image acquisition unit 21. As described above, the distance between the detection position of the mechanical detection sensor 51 and the acquisition position of the image acquisition unit 21 is Li. Thus, when the reset count value CNT1 of the reference pulse reaches a count value Pi corresponding to the distance Li, the image acquisition unit 21 starts acquiring the image. When the count value CNT1 reaches a count value (Pi+P0) corresponding to a distance (Li+L0), the image acquisition unit 21 stops acquiring the image. Note that, for the start of image acquisition, a margin Mi1 may be provided so that the image acquisition unit 21 starts acquiring an image when the count value CNT1 reaches a count value (Pi−Mi1). Similarly, for the stop of image acquisition, a margin Mi2 may be provided so that the image acquisition unit 21 stops acquiring an image when the count value CNT1 reaches a count value (Pi+P0+Mi2).

The fourth from the top in FIG. 4B shows thickness detection timing of the thickness detection unit 22. The distance between the detection position of the mechanical detection sensor 51 and the detection position of the thickness detection unit 22 is Lt. Thus, similarly to the above, when the count value CNT1 reaches a count value Pt corresponding to the distance Lt, the thickness detection unit 22 starts detecting the thickness. When the count value CNT1 reaches a count value (Pt+P0) corresponding to a distance (Lt+L0), the thickness detection unit 22 stops detecting the thickness. A margin may be provided for the start and/or stop of thickness detection by the thickness detection unit 22, similarly to the above.

The fifth from the top in FIG. 4B shows magnetic detection timing of the magnetic detection unit 23. As described above, the distance between the detection position of the mechanical detection sensor 51 and the detection position of the magnetic detection unit 23 is Lm. Thus, similarly to the above, when the count value CNT1 reaches a count value Pm corresponding to the distance Lm, the magnetic detection unit 23 starts detecting the magnetism. When the count value CNT1 reaches a count value (Pm+P0) corresponding to a distance (Lm+L0), the magnetic detection unit 23 stops detecting the magnetism. A margin may be provided for the start and/or stop of magnetism detection by the magnetic detection unit 23, similarly to the above.

The tracking sensor 5 provided in the recognition unit 2 is constituted by the mechanical detection sensor 51 shown in FIG. 3. Thus, as described above, it is possible to reliably detect the banknote BN without erroneous detection even if the banknote BN is a banknote having a transparent part. Thus, it is possible to reliably and accurately perform the image acquisition, the thickness detection, and the magnetism detection in the recognition unit 2.

Note that at least one of the plurality of tracking sensors 5 arranged in the respective positions in line in the direction orthogonal to the transport direction of the banknote BN in the recognition unit 2 may be constituted by the mechanical detection sensor 51.

Instead of starting or stopping the detection of images, thicknesses, and magnetic information, the image acquisition unit 21, the thickness detection unit 22, and the magnetic detection unit 23 may always detect and store the images, thicknesses, and magnetic information to extract necessary parts from the detected images, thicknesses, and magnetic information based on the time when the tracking sensor 5 located upstream in the transport direction detects the end of the banknote BN.

(Control of Diversion Unit)

As described above, the diversion control of the diversion unit 33, 34 is performed based on the detection signal of the mechanical detection sensor 51. Specifically, the control is performed in the same manner as that in the recognition unit 2. That is, the count value of the reference pulse corresponding to the distance between the diversion position of the diversion unit 33, 34 and the detection position of the mechanical detection sensor 51 is known in advance. Thus, when the count reaches a predetermined count value from the timing when the mechanical detection sensor 51 detects the banknote BN, a necessary diversion operation is performed in the diversion unit 33, 34. A margin may be provided for the predetermined count value related to the diversion operation.

(First Variation)

In the configuration described above, all of the tracking sensors 5 arranged in the banknote handling device 1 are constituted by the mechanical detection sensors 51. Alternatively, the tracking sensors 5 may be configured by combination of the mechanical detection sensors 51 and the optical detection sensors.

FIGS. 5A to 5D each illustrate a configuration example of combination of the mechanical detection sensors 51 and optical detection sensors 52. FIGS. 5A to 5D each include a section (a) showing an arrangement example of the plurality of tracking sensors 5 arranged along the transport path of the banknote BN. A section (b) shows detection signals of the tracking sensor 5 corresponding to the configuration of the section (a). Here, a horizontal axis in the section (b) is a count value CNT2 of the reference pulse. The reference pulse uses an output pulse of a rotary encoder attached to the driving roller of the transport unit 3. The number of reference pulses is proportional to a transport distance of the banknote BN. Note that, if the transport speed of the banknote BN is constant, the following operations may be conducted with reference to the actual time instead of using the reference pulse. Note that, in FIGS. 5A to 5D, the arrangement configuration of the tracking sensors 5 is identical, but the types of the transported banknotes BN are different.

As described above, the mechanical detection sensor 51 includes the pair of rollers 511, 512. The optical detection sensor 52 includes a light emission unit 521 disposed on one side (the lower side of the page of FIG. 5) and a light reception unit 522 disposed on the other side (the upper side of the page of FIG. 5), both the sides sandwiching the banknote BN during transport. When the banknote BN passes across the optical axis of the optical detection sensor 52, the banknote BN blocks light. Accordingly, the optical detection sensor 52 detects a pass of the banknote BN. That is, when the light reception unit 522 is switched from light transmission to light blocking, this means that the leading end of the banknote BN is detected. When the light reception unit 522 is switched from light blocking to light transmission, this means that the trailing end of the banknote BN is detected.

Figure 5A:
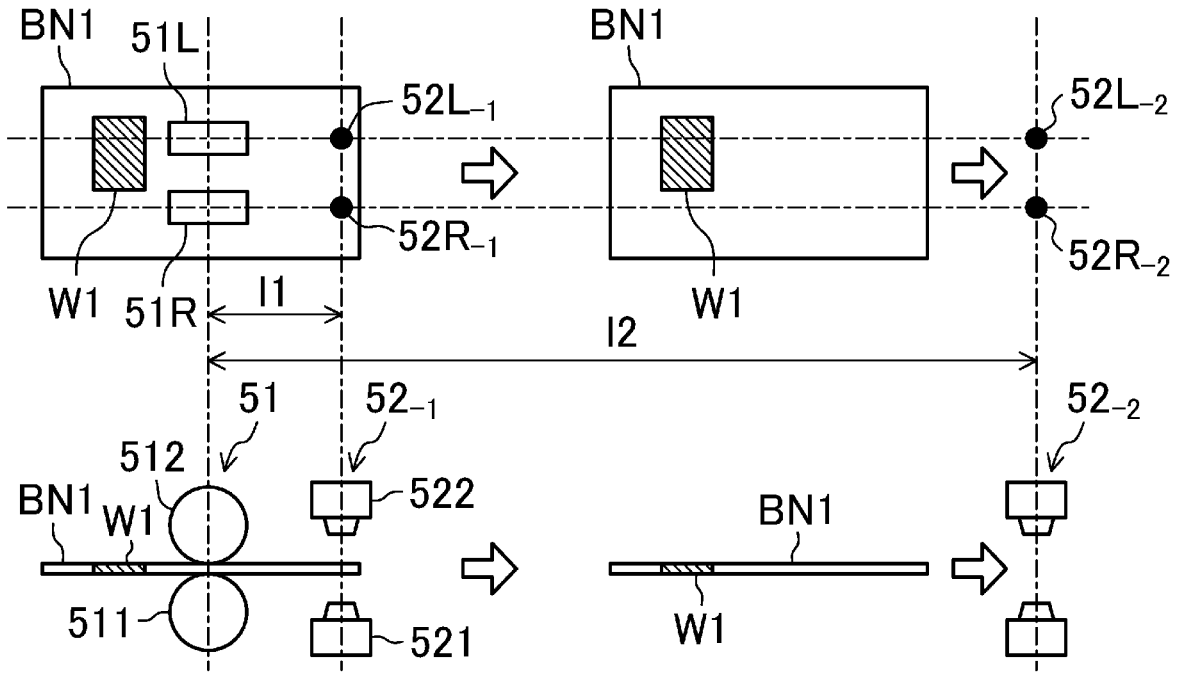
FIG. 5A illustrates a configuration of combination of mechanical detection sensors and optical detection sensors for detecting a banknote having a transparent part.
Figure 5A:
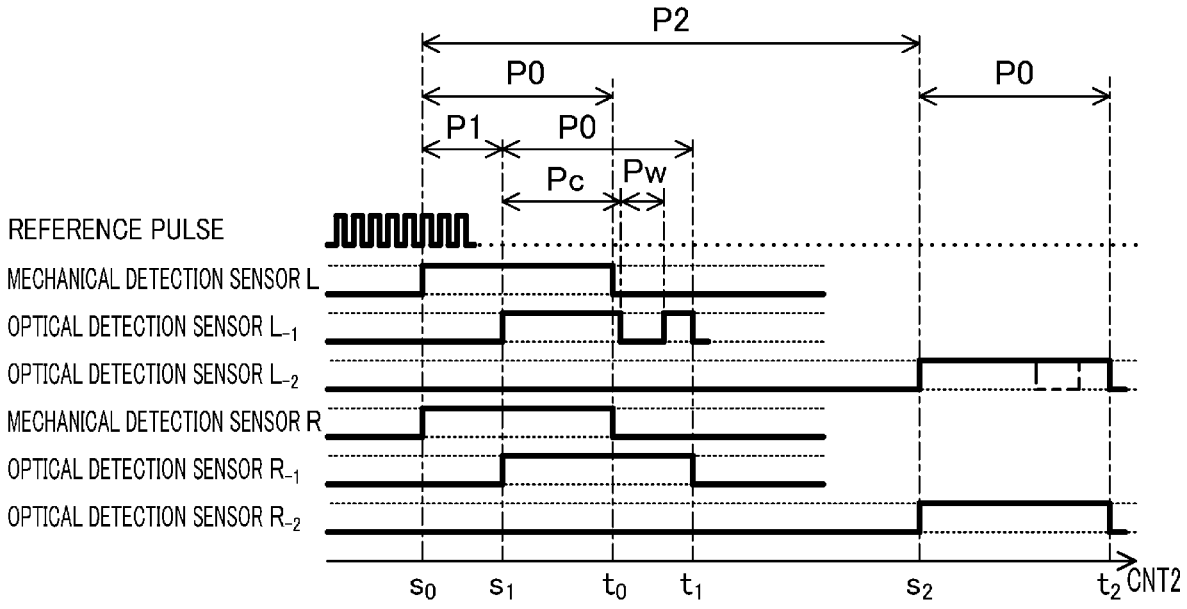

In the arrangement examples of FIGS. 5A. to 5D, the mechanical detection sensor 51 and the optical detection sensor 52 are arranged in line at the most upstream position in the transport direction, on the transport path on which the banknote BN is transported from left to right in the drawing. The interval between the mechanical detection sensor 51 and the optical detection sensor 52 is 11. At the downstream position thereafter, only the optical detection sensor 52 is disposed. In the illustrated example, the optical detection sensors 52 disposed at different positions in the transport direction are distinguished by reference numerals $\mathbf{52}_{-1}$, $\mathbf{52}_{-2}$. The interval between the mechanical detection sensor 51 and the optical detection sensor $\mathbf{52}_{-2}$ is 12.

At each position in the transport direction of the banknote BN, the two mechanical detection sensors 51L, 51R and the two optical detection sensors 52L, 52R are arranged in the short edge direction orthogonal to the transport direction of the banknote BN. Each set of the two mechanical detection sensors 51L, 51R and the two optical detection sensors 52L, 52R are located at the same position in the width direction of the transport path (the short edge direction of the banknote BN) with respect to the transport direction, i.e., located on the same line (see the one-dot chain line in the upper part of FIGS. 5A to 5D).

In the example shown in FIG. 5A, the banknote BN1 having the transparent part W1 is transported. As described above, the banknote BN1 is a banknote having the transparent part W1 formed in a window shape (see FIG. 7). First, at the count value $s_0$, the leading end of the banknote BN1 is detected by the mechanical detection sensor 51. Then, at the count value to, the trailing end of the banknote BN1 is detected. As described above, regardless of the presence or absence of the transparent part W1, the mechanical detection sensor 51 accurately and reliably detects the leading end (i.e., one end in the long edge) and the trailing end (i.e., the other end in the long edge) of the banknote BN1 in the transport direction. Thus, the detection signals of the mechanical detection sensors 51L, 51R as shown in the section (b) of FIG. 5A are obtained and stored. The left side of the page corresponds to the leading end of the banknote in the transport direction, and the right side of the page corresponds to the trailing end of the banknote in the transport direction. Similarly to the above, a count value corresponding to the length L0 of the banknote BN1 is obtained from the difference ($t_0-s_0=P0$) between the count value at the start of detection by the mechanical detection sensor 51 and the count value at the time of non-detection.

The two detection signals, including the detection timing, of the mechanical detection sensors 51L, 51R are basically the same, when the banknote BN1 is properly transported without skew feeding. When the two detection timings (i.e., the count value $s_0$ and the count value $t_0$) of the mechanical detection sensors 51L, 51R are different, it can be determined that the leading end in the transport direction of the banknote BN is inclined. Thus, it can be determined that the banknote BN is skewed.

Here, for brief descriptions, a case where there is no skew of the banknote BN1 will be described. The count value $s_n$, count value $t_n$, and count value $P_n$ are values held by the detection sensors for each line. When there is no skew of the banknote BN, the count values of the detection sensors located at the same position in the transport direction are the same. Thus, one count value will be used as a representative of the count values of the detection sensors for each line.

When the count value CNT2 reaches $s_1$, the storage of the detection signals of the optical detection sensors $\mathbf{52}L_{-1}$, $\mathbf{52}R_{-1}$ is started. Note that $s_1=s_0+P1$ where P1 is a count value corresponding to the interval 11 between the mechanical detection sensor 51 and the optical detection sensor $\mathbf{52}_{-1}$. When the count value CNT2 reaches $t_1$, the storage of the detection signals of the optical detection sensors $\mathbf{52}L_{-1}$, $\mathbf{52}R_{-1}$ is ended. Note that $t_1=s_1+P0$ where P0 is a count value corresponding to the length. L0 of the banknote BN1 as described above.

As illustrated in FIG. 5A, the transparent part W1 is translucent, and thus the detection signal of the optical detection sensor $\mathbf{52}L_{-1}$ is different from the detection signal of the mechanical detection sensor 51. The optical detection sensor $\mathbf{52}R_{-1}$ does not pass through the transparent part W1, and thus the detection signal of the optical detection sensor $\mathbf{52}R_{-1}$ is the same as the detection signal of the mechanical detection sensor 51, and different from the optical detection sensor $\mathbf{52}L_{-1}$.

The control unit 6 compares the detection signals of the two mechanical detection sensors 51 with the detection signal of the two optical detection sensors $\mathbf{52}_{-1}$. Accordingly, the control unit 6 specifies the transparent part W of the banknote BN. Specifically, the detection signals of the two mechanical detection sensors 51 are compared when the count value CNT2 is from $s_0$ to $t_0$ to detect the presence or absence of skew, break, or fold of the banknote, and to calculate the length of the banknote. Next, the detection signal ($s_0 \rightarrow t_0$) of the mechanical detection sensor 51 when the count value CNT2 is from $s_0$ to $t_0$ and the detection signal ($s_1 \rightarrow t_1$) of the optical detection sensor 52 on the same line when the count value CNT2 is from $s_1$ to $t_1$ are compared. When these detection signals are different, it is determined that the banknote BN has the transparent part W, and then the start position and the length of the transparent part W are determined. In the example of FIG. 5A, the detection signal ($s_0 \rightarrow t_0$) of the mechanical detection sensor 51L and the detection signal ($s_1 \rightarrow t_1$) of the optical detection sensor $\mathbf{52}L_{-1}$ can be compared to determine the start position $P_C$ of the transparent part W1 in the banknote BN1, and the length $P_W$ of the transparent part W1.

If, at the most upstream position in the transport direction of the banknote BN, it is determined whether or not the banknote BN has the transparent part W, and the position of the transparent part W is specified, such information is used for detection conducted by the optical detection sensors 52 arranged at the downstream position thereafter. As illustrated in FIG. 5A, when the banknote BN1 has the transparent part W1, the downstream optical detection sensor $\mathbf{52}L_{-2}$ might perform erroneous detection. Thus, the detection result of the optical detection sensor $\mathbf{52}L_{-2}$ performing a detection when the banknote BN1 moves from the mechanical detection sensor 51L by a distance corresponding to the interval 12 is corrected.

Specifically, when the count value CNT2 reaches $s_2$, the optical detection sensors $\mathbf{52}L_{-2}$, $\mathbf{52}R_{-2}$ detect the leading end of the banknote BN1, and the detection signals turn to the detection state. Note that $s_2=s_0+P2$ where P2 is a count value corresponding to the interval 12 between the mechanical detection sensor 51 and the optical detection sensor $\mathbf{52}_{-2}$. When the detection signals of the optical detection sensors $\mathbf{52}L_{-2}$, $\mathbf{52}R_{-2}$ turn into the detection state and then reach the count value ($s_2+P_C$) corresponding to the start position of the transparent part W1, the detection of the banknote BN1 by the optical detection sensor $\mathbf{52}L_{-2}$ on the line through which the transparent part W1 passes is stopped during the count value $P_W$ corresponding to the length of the transparent part W1. Then, after the elapse of the count value $P_W$, the detection of the banknote BN1 is restarted. When the count value t2 ($t_2=s_2+P_0$) is reached; the detection signals of the optical detection sensors $\mathbf{52}L_{-2}$, $\mathbf{52}R_{-2}$ turn from the detection state to the non-detection state, and the optical detection sensors $\mathbf{52}L_{-2}$, $\mathbf{52}R_{-2}$ detect the trailing end of the banknote BN1. This allows the transparent part W1 to be ignored not detected, and prevents the optical detection sensor $\mathbf{52}L_{-2}$ from conducting erroneous detection. Instead of stopping the detection of the banknote BN1 by the optical detection sensor $\mathbf{52}L_{-2}$, the detection signal may be changed to the detection state in a period from the count value ($s_2+P_C$) to the count value $P_W$.

Unlike this, the detection signal of the mechanical detection sensor 51 and the detection signal of the optical detection sensor $\mathbf{52}_{-1}$ may be used to detect only that the banknote BN1 has the transparent part W1, such that the start position $P_C$ of the transparent part W1 in the banknote BN1 and the length $P_W$ of the transparent part W1 are not determined. In this case, the detection by the optical detection sensor $\mathbf{52}L_{-2}$ arranged at the downstream position can be corrected as follows.

That is, after the count value CNT2 reaches $s_2$, the detection signal of the optical detection sensor $\mathbf{52}L_{-2}$ in the line through which the transparent part W1 passes is forcibly turned to a banknote detection state until the elapse of the count value $P_0$ corresponding to the length of the banknote BN1, regardless of whether or not the sensor performs an actual detection. Then, if the detection by the optical detection sensor $\mathbf{52}L_{-2}$ is returned to the normal state when the count value $P_0$ elapses, the detection state is turned to a non-detection state and the trailing end of the banknote BN1 is detected.

As such, at least one mechanical detection sensor 51 is arranged so as to prevent the optical detection sensor $\mathbf{52}_{-2}$ arranged downstream thereof from conducting erroneous detection.

Figure 5B:
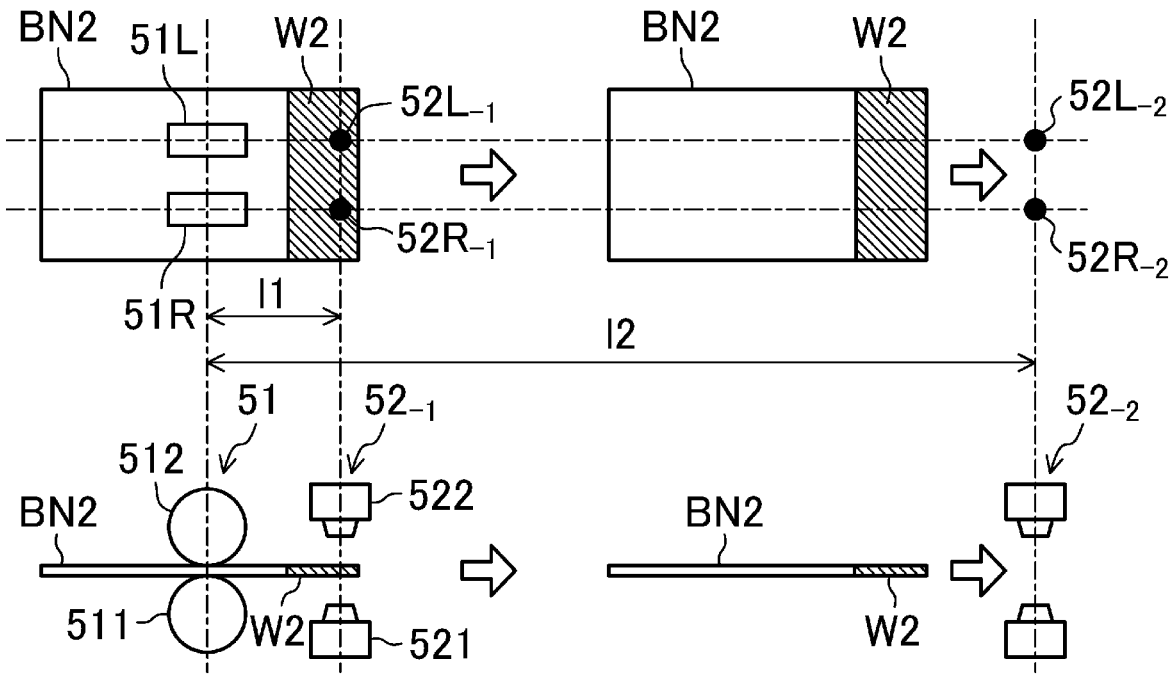
FIG. 5B illustrates a configuration of combination of mechanical detection sensors and optical detection sensors for detecting a banknote having a transparent part different from that of FIG. 5A.
Figure 5B:
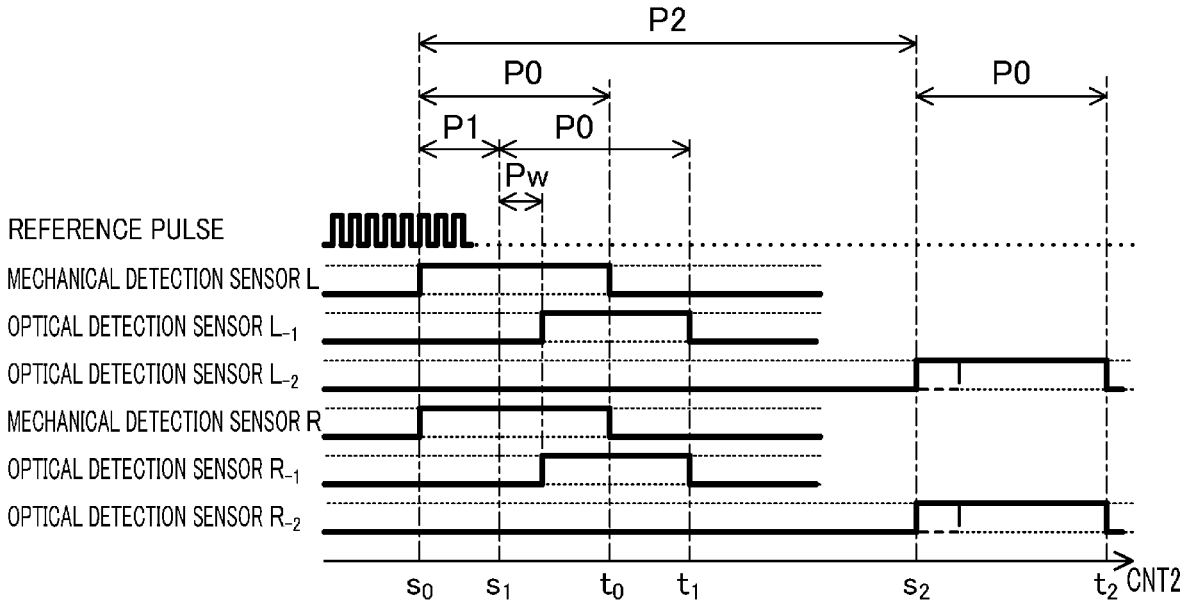

Next, in the example shown in FIG. 5B, the banknote BN2 having the transparent part W2 at one end of the long edge direction of the banknote BN2 is transported (see FIG. 7). First, the banknote BN2 is detected by the mechanical detection sensors 51. Thus, the detection signals ($s_0 \rightarrow t_0$) of the mechanical detection sensors 51L, 51R as shown in FIG. 5B are obtained and stored.

Similarly to the above, when the count value CNT2 reaches $s_1$, the storage of the detection signals of the optical detection sensors $\mathbf{52}L_{-1}$, $\mathbf{52}R_{-1}$ is started, so that, when the banknote BN2 is transported by the interval 11, the optical detection sensors $\mathbf{52}_{-1}$ detect the banknote BN2. However, the transparent part W2 is translucent, and thus the optical detection sensors $\mathbf{52}L_{-1}$, $\mathbf{52}R_{-1}$ cannot detect the leading end of the banknote BN2 in practice. As illustrated in FIG. 5B, the optical banknote detection sensors $\mathbf{52}L_1$, $\mathbf{52}R_{-1}$ detect the banknote BN2 after the transparent part W2 has passed. When the count value CNT2 reaches $t_1$, the storage of the detection signals of the optical detection sensors $\mathbf{52}L_{-1}$, $\mathbf{52}R_{-1}$ is ended.

The control unit 6 compares, for each line, the detection signals ($s_0 \rightarrow t_0$) of the mechanical detection sensors 51 with the detection signals ($s_1 \rightarrow t_1$) of the two optical detection sensors $\mathbf{52}_{-1}$. Accordingly, the control unit 6 specifies the transparent part W2 of the banknote BN2. In the example of FIG. 5B, the length $P_W$ of the transparent part W2 is determined where the start position $P_C$ of the transparent part W2 in the banknote BN2 is 0.

If, at the most upstream position in the transport direction of the banknote BN, it is determined whether or not the banknote BN has the transparent part W, and the position of the transparent part W is specified, such information is used for detection conducted by the optical detection sensors $\mathbf{52}_{-2}$ arranged at the downstream position. If the banknote BN2 has the transparent part W2, the detection result of the optical detection sensor $\mathbf{52}_{-2}$ performing a detection when the banknote moves from the mechanical detection sensor 51 by a distance corresponding to the interval 12 is corrected as shown by the solid line in, e.g., FIG. 5B (see the sold line and two-dot chain line in the drawing). The correction in this case is performed in accordance with the example in FIG. 5A.

Figure 5C:
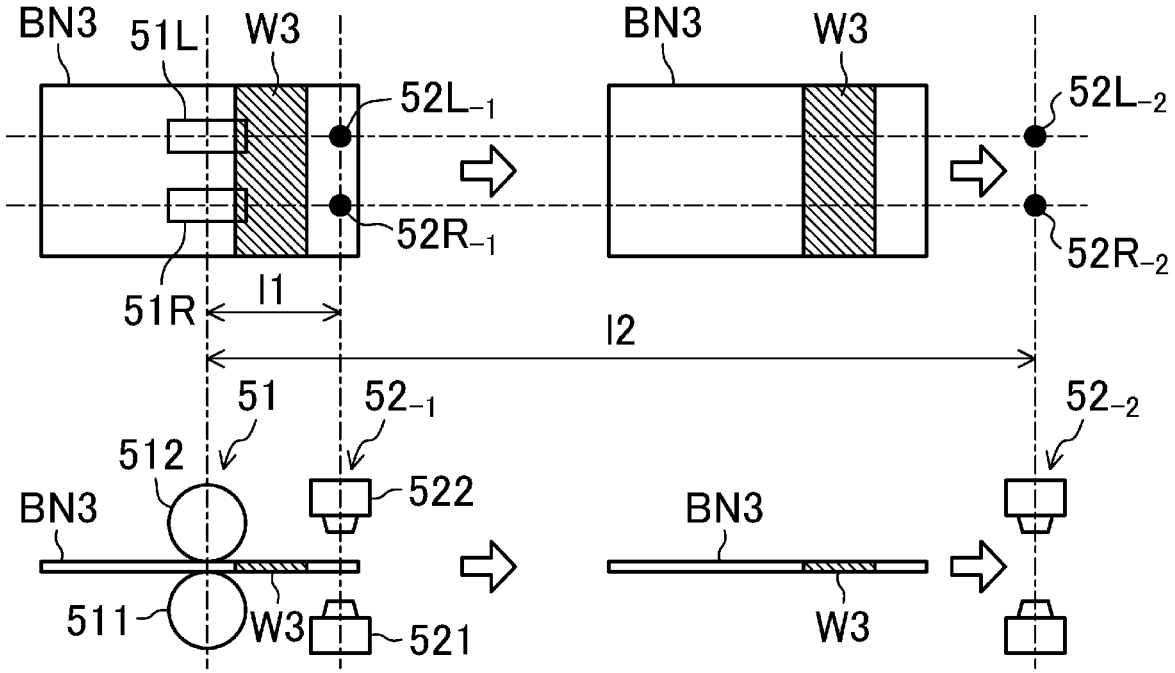
FIG. 5C illustrates a configuration of combination of mechanical detection sensors and optical detection sensors for detecting a banknote having a transparent part different from those of FIGS. 5A and 5B.
Figure 5C:
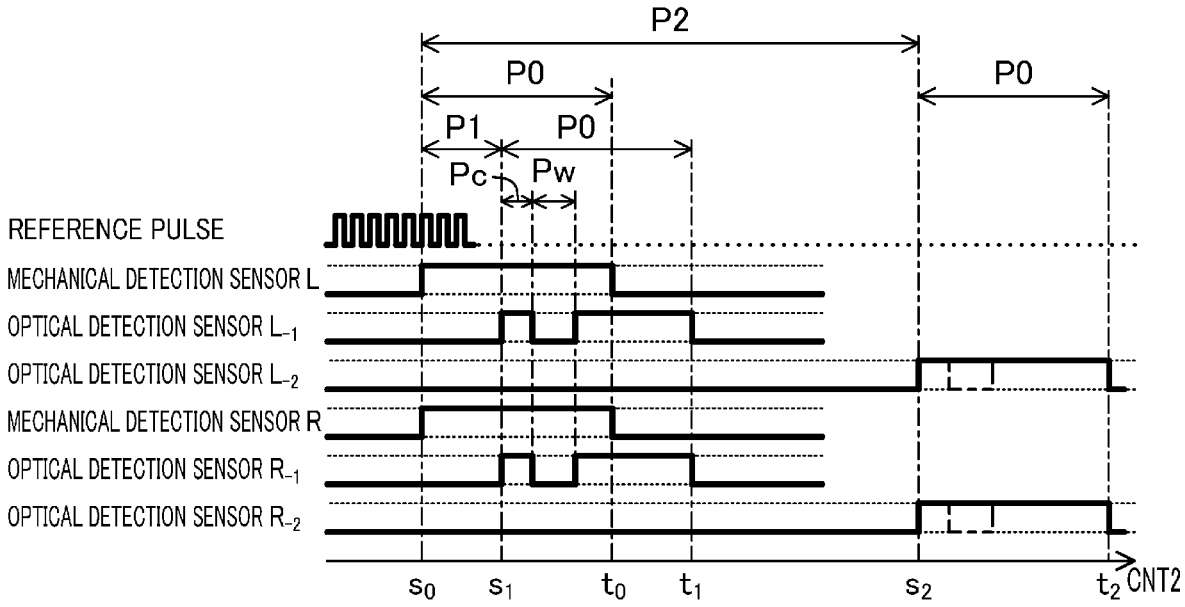

Next, in the example shown in FIG. 5C, the banknote BN3 having the transparent part W3 at the middle thereof in the long edge direction of the banknote BN3 is transported (see FIG. 7). First, the banknote BN3 is detected by the mechanical detection sensors 51. The detection signals ($s_0 \rightarrow t_0$) of the mechanical detection sensors 51L, 51R as shown in FIG. 5C are obtained and stored.

Similarly to the above, when the count value CNT2 reaches $s_1$, the storage of the detection signals of the optical detection sensors $\mathbf{52}_{-1}$ is started. However, the transparent part W3 is translucent. Thus, as shown by the solid line in FIG. 5C, the optical detection sensors $\mathbf{52}L_{-1}$, $\mathbf{52}R_{-1}$ cannot detect the banknote BN3 at the middle of the banknote BN3. Thereafter, the optical detection sensors $\mathbf{52}L_{-1}$, $\mathbf{52}R_{-1}$ detect the banknote BN3 again. The storage of the detection signals of the optical detection sensors $\mathbf{52}L_{-1}$, $\mathbf{52}R_{-1}$ is continued regardless of whether or not the sensors perform detection. When the count value CNT2 reaches $t_1$, the storage of the detection signals of the optical detection sensors $\mathbf{52}L_1$, $\mathbf{52}R_{-1}$ is ended.

The control unit 6 compares, for each line, the detection signals ($s_0 \rightarrow t_0$) of the mechanical detection sensors 51 with the detection signals ($s_1 \rightarrow t_1$) of the two optical detection sensors $\mathbf{52}_{-1}$. Accordingly, the control unit 6 specifies the transparent part W3 of the banknote BN3. That is, the start position $P_C$ of the transparent part W3 in the banknote BN3 and the length $P_W$ of the transparent part W3 are determined.

As such, if, at the most upstream position in the transport direction of the banknote BN, it is determined whether or not the banknote BN has the transparent part W, and the position of the transparent part W is specified, such information is used for detection conducted by the optical detection sensors $\mathbf{52}_{-2}$ arranged at the downstream position. As illustrated in FIG. 5C, if the banknote BN3 has the transparent part W3, the detection result of the optical detection sensor $\mathbf{52}_{-2}$ performing a detection when the banknote moves from the mechanical detection sensor 51 by a distance corresponding to the interval 12 is corrected (see the sold line and two-dot chain line in the drawing). The correction in this case is also performed in accordance with the example in FIG. 5A.

Figure 5D:
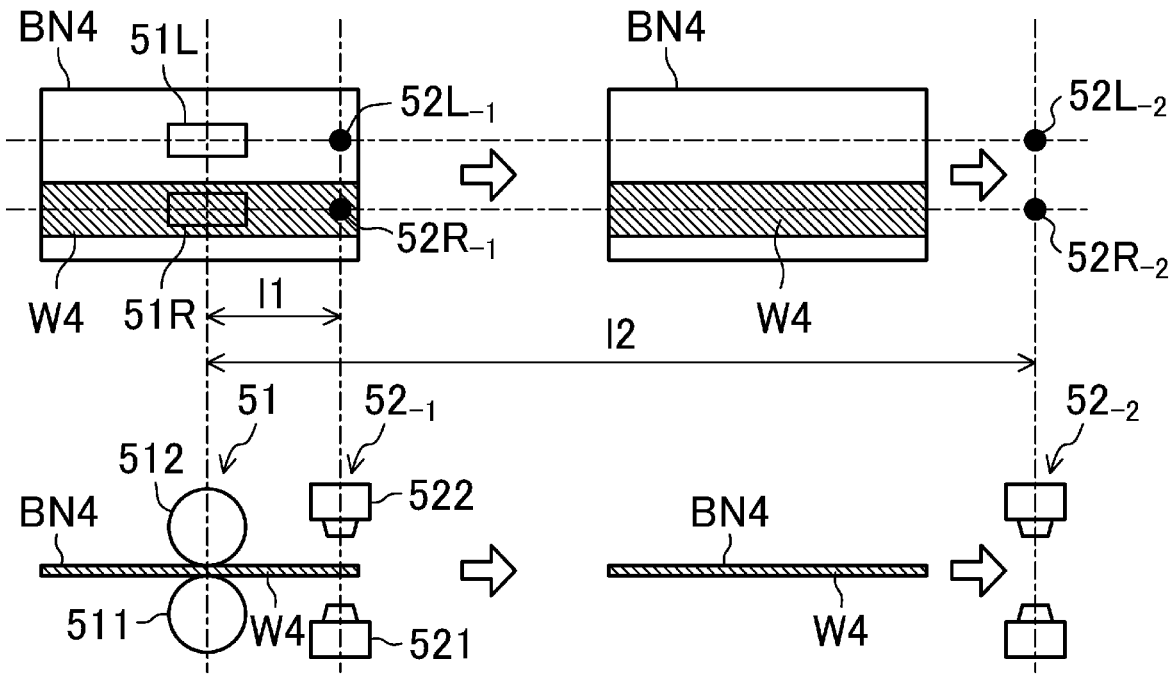
FIG. 5D illustrates a configuration of combination of mechanical detection sensors and optical detection sensors for detecting a banknote having a transparent part different from those of FIGS. 5A to 5C.
Figure 5D:
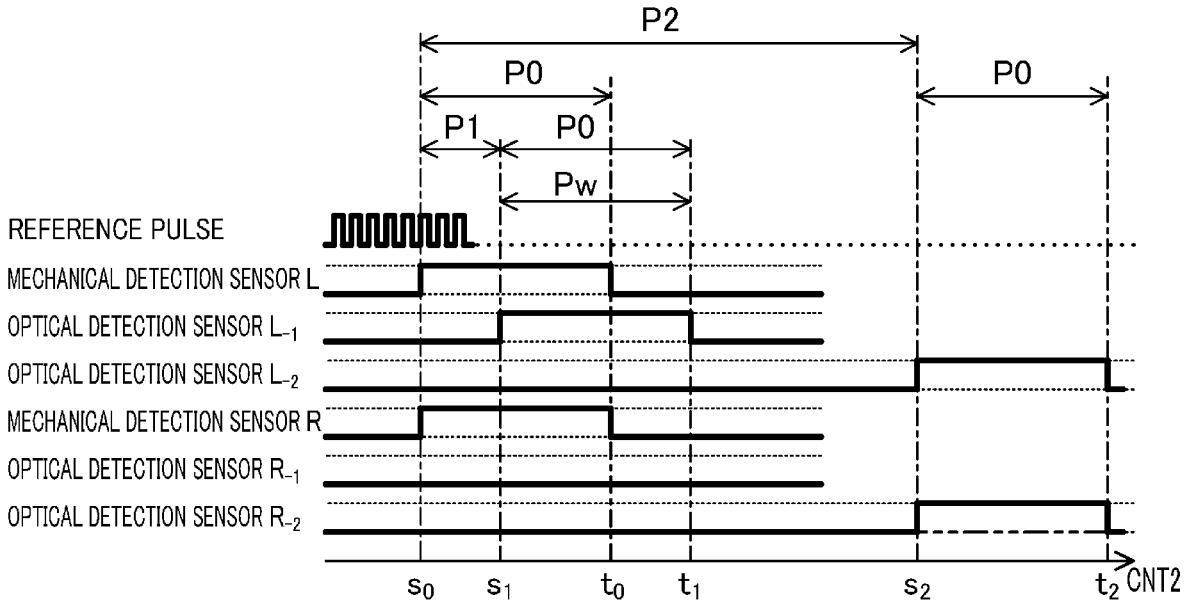

Next, in the example shown in FIG. 5D, the banknote BN4 having the transparent part W4 extending in a band shape from end to end of the long edge direction is transported (see FIG. 7). First, the banknote BN4 is detected by the mechanical detection sensors 51. The detection signals ($s_0 \rightarrow t_0$) of the mechanical detection sensors 51L, 51R as shown in FIG. 5D are obtained and stored.

Similarly to the above, when the count value CNT2 reaches $s_1$, the storage of the detection signals of the optical detection sensors $\mathbf{52}_{-1}$ is started. However, the transparent part W4 is translucent. Thus, as illustrated in FIG. 5D, the optical detection sensor $\mathbf{52}L_{-1}$ detects the banknote B4 whereas the optical detection sensor $\mathbf{52}R_{-1}$ does not detect the banknote BN4. The storage of the detection signals of the optical detection sensors $\mathbf{52}L_{-1}$, $\mathbf{52}R_{-1}$ is continued regardless of whether or not the optical detection sensors $\mathbf{52}L_{-1}$, $\mathbf{52}R_{-1}$ perform detection. Then, when the count value CNT2 reaches $t_1$, the storage of the detection signals of the optical detection sensors $\mathbf{52}L_{-1}$, $\mathbf{52}R_{-1}$ is ended.

The control unit 6 compares, for each line, the detection signals ($s_0 \rightarrow t_0$) of the two mechanical detection sensors 51L, 51R with the detection signals ($s_1 \rightarrow t_1$) of the two optical detection sensors $\mathbf{52}L_{-1}$, $\mathbf{52}R_{-1}$. Accordingly, the control unit 6 specifies the transparent part W4 of the banknote BN4. In this example, the start position $P_C$ of the transparent part W4 in the banknote BN4 is 0, and the length $P_W$ of the transparent part W4 is equal to P0 corresponding to the length of the banknote BN4.

If, at the most upstream position in the transport direction of the banknote BN, it is determined whether or not the banknote BN has the transparent part W, and the position of the transparent part W is specified, such information is used for detection conducted by the optical detection sensors $\mathbf{52}_{-2}$ arranged at the downstream position. As illustrated in FIG. 5D, if the banknote BN4 has the transparent part W4, the detection result of the optical detection sensor $\mathbf{52}R_{-2}$ performing a detection when the banknote moves from the mechanical detection sensor 51 by a distance corresponding to the interval 12 is corrected (see the sold line and two-dot chain line in the drawing). The correction in this case is also performed in accordance with the example in FIG. 5A.

Figure 6:
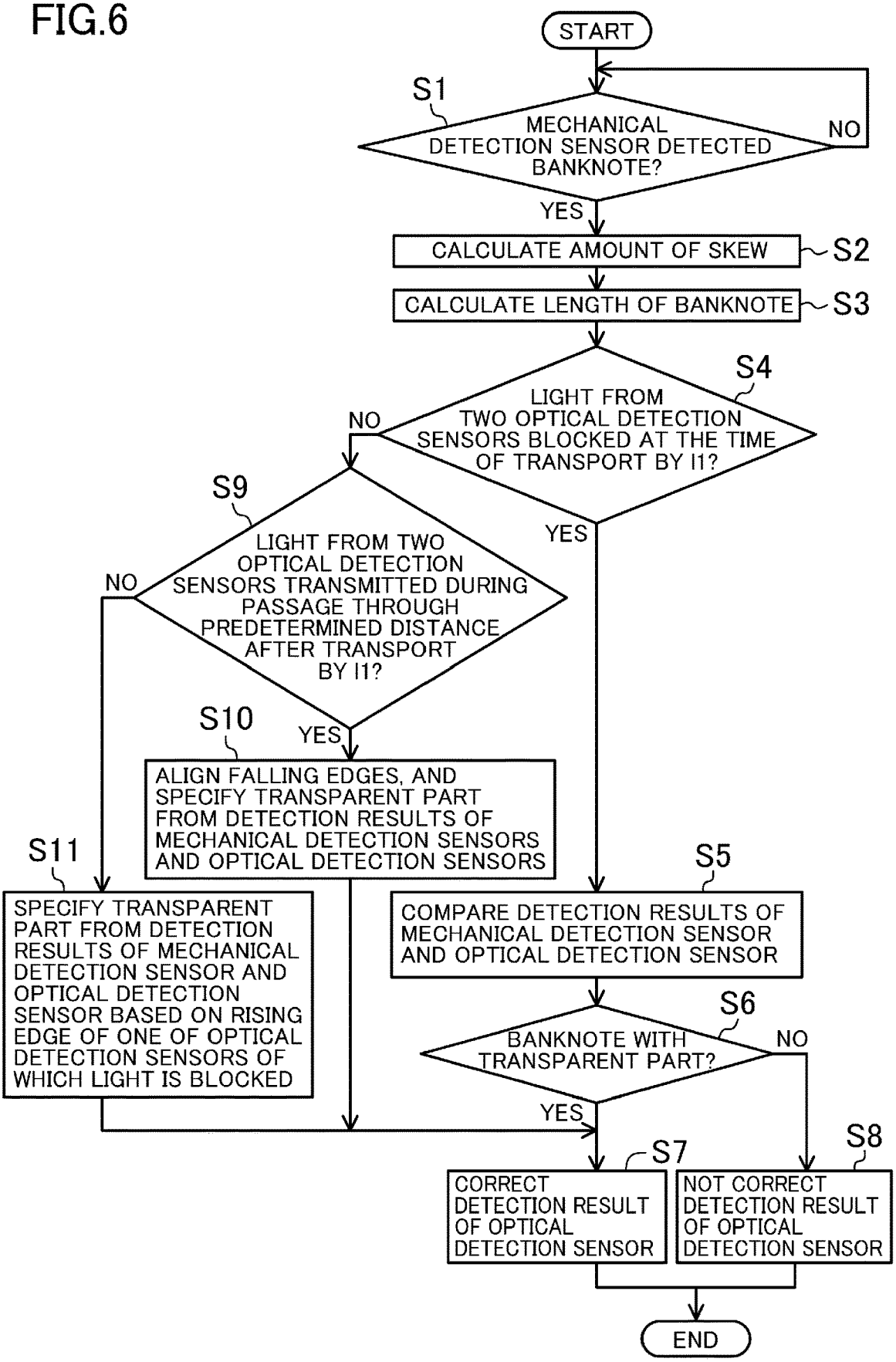
FIG. 6 is a flowchart relating, to handling of a detection result in the configuration of combination of the mechanical detection sensors and the optical detection sensors.

FIG. 6 is a flowchart relating to the handling of the detection result in each of the configuration examples shown in FIGS. 5A to 5D. In the flowchart of FIG. 6, the arrangement of the sensors and the detection signals of the sensors are the same as those in FIGS. 5A to 5D, but the handling based thereon is different from the handling described above.

First, in step S1 after the start, it is determined whether or not the mechanical detection sensors 51 detect a banknote. If no, the step S1 is repeated, and if yes, the process proceeds to step S2.

In step S2, the amount of skew of the banknote BN is calculated based on the detection signals obtained by the two mechanical detection sensors 51R, 51L. The amount of skew, i.e., the magnitude of inclination of the leading end of the banknote BN in the transport direction can be calculated based on the deviation of the timings (i.e., the count value $s_0$ and/or the count value $t_0$) detected by the two mechanical detection sensors 51L, 51R. If the amount of skewing exceeds a preset amount, it is determined that the banknote is a rejected banknote.

In step S3, the length of the banknote BN (i.e., the length in the transport direction, or, here, the length in the long edge direction) is calculated based on the detection signals obtained by the mechanical banknote detecting sensors 51L, 51R. As described above, the count value corresponding to the length of the banknote BN can be calculated from the difference ($t_0 - s_0 = P_0$) between the count value at the start of detection by the mechanical detection sensor 51 and the count value at the time of non-detection. Note that the lengths of the banknote BN calculated from the detection signals of the two mechanical detection sensors 51L, 51R are compared with each other. If the difference thereof exceeds a preset amount, it is determined that the banknote is torn.

In step S4, when the banknote BN is transported by 11, i.e., when the count value CNT2 reaches $s_1$ ($=s_0+P1$), it is determined whether or not light from both of the two optical detection sensors $\mathbf{52}L_{-1}$, $\mathbf{52}R_{-1}$ is blocked. If light from both of the sensors are not blocked, i.e., if light from either one of the optical detection sensors $\mathbf{52}_{-1}$ is not blocked, or if light from both of the two optical detection sensors $\mathbf{52}_{-1}$ not blocked, the process proceeds to step S9. If the process proceeds to step S9, it is determined that the banknote BN is the banknote BN2 shown in FIG. 5B or the banknote BN4 shown in FIG. 5D. On the other hand, if light from both of the two optical detection sensors $\mathbf{52}L_{-1}$, $\mathbf{52}R_{-1}$ is blocked, the process proceeds from step S4 to step S5. If the process proceeds to step S5, it is determined that the banknote BN is the banknote BN1 shown in FIG. 5A, the banknote BN3 shown in FIG. 5C, or the banknote having no transparent part.

In step S5, the detection result ($s_0 \rightarrow t_0$) of the mechanical detection sensor 51 and the detection result ($s_1 \rightarrow t_1$) of the optical detection sensor 52 are compared for each line. Accordingly, the presence or absence of the transparent W of the banknote BN is specified. If the transparent part W is present, the position of the transparent part W (that is, $P_C$, $P_W$) may be specified.

In the following step S6, it is determined whether or not the banknote BN has the transparent part W. If yes, the process proceeds to step S7, and if no, the process proceeds to step S8.

In step S7, the detection result of the optical detection sensor $\mathbf{52}_{-2}$ disposed downstream in the transport direction is corrected as described above. On the other hand, in step S8, the detection result of the optical detection sensor $\mathbf{52}_{-2}$ disposed downstream in the transport direction is not corrected.

In step S9, after the banknote BN is transported by 11, it is determined whether or not light from both of the two optical detection sensors $\mathbf{52}_{-1}$ is transmitted during the pass by a predetermined distance (i.e., a predetermined count value). If the determination is YES, the process proceeds to step S10. If the determination is NO, the process proceeds to step S11.

If the process proceeds to step S10, it is determined that the banknote BN is the banknote BN2 shown in FIG. 5B. In step S10, the falling edges of the detection signals of the mechanical detection sensors 51L, 51R and the falling edges of the detection signals of the optical detection sensors $\mathbf{52}L_{-1}$, $\mathbf{52}R_{-1}$ are aligned and compared so that the transparent part W2 is specified. Then, the process proceeds to step S7, and the detection result of the optical detection sensor $\mathbf{52}_{-2}$ disposed downstream in the transport direction are corrected.

If the process proceeds to step S11, it is determined that the banknote BN is the banknote BN4 shown in FIG. 5D. In step S11, the detection signal of the mechanical detection sensor 51 and the detection signal of the optical the detection sensor $\mathbf{52}_{-1}$ are compared based on the rising edge of the detection signal of the optical detection sensor 52, of which light is not transmitted, among the two optical detection sensors $\mathbf{52}L_{-1}$, $\mathbf{52}R_{-1}$. At this time, the amount of skew calculated in step S2 is taken into consideration. Then, the transparent part W4 of the banknote BN4 is specified. Then, the process proceeds to step S7, and the detection result of the optical detection sensor $52_{-2}$ disposed downstream in the transport direction are corrected.

Note that the combination of the mechanical detection sensor 51 and the optical detection sensor 52 is not limited to the above-described combinations. For example, the mechanical detection sensor 51 is not limited to the one mechanical detection sensors 51 disposed at the most upstream position, and may be mechanical detection sensors 51 disposed at any positions on the transport path 31 and the connection paths 32 on which the optical detection sensors are disposed.

The optical detection sensor 52 in combination with the mechanical detection sensor 51 is not limited to the transmissive optical detection sensor, and may be a reflective optical detection sensor. The reflective optical detection sensor has a light emission unit 521 and a light reception unit 522 arranged on the same side. The light emission unit 521 emits light, and then the light reception unit 522 receives the light 5, reflected from the transported banknote BN. The light reception state corresponds to the light blocking described above, and the non light reception state corresponds to the light transmitting described above.

As described above, the mechanical detection sensor 51 disclosed herein is disposed on the transport path 31 or the connection path 32, and includes the pair of rollers 511, 512 which face each other and between which the banknote BN passes, and the detection unit 519 to detect the displacement of the roller 512 when the banknote BN passes between the pair of rollers 511, 512 to detect the banknote BN.

This mechanical detection sensor 51 can accurately detect the banknote BN regardless of whether or not the banknote BN has the transparent part W.

The banknote handling device 1 disclosed herein includes the tracking sensor 5 arranged in the transport path 31 or the connection path 32 transporting the banknote BN and configured to detect the banknote BN, and the handling unit configured to perform handling related to the banknote BN based on the detection of the tracking sensor 5.

The tracking sensor 5 includes the mechanical detection sensor 51 having the pair of rollers 511, 512 facing each other and configured so that the banknote BN passes therebetween, and the detection unit 519 to detect the displacement of the roller 512 when the banknote BN passes between the pair of rollers 511, 512 to detect the banknote BN.

As described above, the mechanical detection sensor 51 can accurately detect the banknote BN regardless of the presence or absence of the transparent part W of the banknote BN. The handling unit performs handling related to the banknote BN based on the detection of the banknote BN, and thus the handling based on the erroneous detection can be avoided. Note that, in the above descriptions, the handling is based on the detection of the leading end of the banknote BN, but the handling may be based on the detection of the trailing end of the banknote BN. Both the leading end and trailing end of the banknote BN may be detected so that the handling may be performed based on the middle of the banknote BN determined therefrom.

The handling unit includes the image acquisition unit 21 disposed downstream of the mechanical detection sensor 51 in the transport direction in the transport path 31, and configured to acquire an image of the banknote BN. The image acquisition unit 21 acquires the image of the banknote BN based on the time when the mechanical detection sensor 51 detects the end of the banknote BN.

Accordingly, the image of the banknote BN can be acquired appropriately during the transportation.

The handling unit includes the thickness detection unit 22 disposed downstream of the mechanical detection sensor 51 in the transport direction in the transport path 31, and configured to detect the thickness of the banknote BN. The thickness detection unit 22 detects the thickness of the banknote BN based on the time when the mechanical detection sensor 51 detects the end of the banknote BN.

Accordingly, the thickness of the banknote BN being transported can be detected appropriately. In this configuration, the mechanical detection sensor 51 detects the thickness of the banknote to detect the banknote being transported, and the thickness detection unit 22 detects the thickness of the banknote BN to accurately detect double feed, chain feed, a fold, etc. of the banknote BN.

The handling unit includes the magnetic detection unit 23 disposed downstream of the mechanical detection sensor 51 in the transport direction in the transport path 31, and configured to detect the magnetic information of the banknote BN. The magnetic detection unit 23 detects the magnetic information of the banknote BN based on the time when the mechanical detection sensor 51 detects the end of the banknote BN. Accordingly, the magnetic information of the banknote BN being transported can be detected appropriately.

The handling unit includes the diversion unit 33, 34 disposed downstream of the mechanical detection sensor 51 in the transport direction in the transport path 31, and configured to switch the destination of the banknote BN. The diversion unit 33, 34 switches the destination of the banknote BN based on the time when the mechanical detection sensor 51 detects the end of the banknote BN. Accordingly, the banknote BN can be transported smoothly.

The tracking sensor 5 further includes the optical detection sensor 52 detecting the banknote BN based on the light irradiated toward the banknote BN: Each of the mechanical detection sensor 51 and the optical detection sensor 52 is disposed on the transport path 31 or the connection paths 32, and detects the banknote BN.

The combination of the mechanical detection sensor 51 and the optical detection sensor 52 enables an appropriate detection of the banknote BN even having the transparent part W, and the optical detection sensor 52, which is inexpensive, can reduce the cost.

The mechanical detection sensor 51 is disposed upstream of the optical detection sensor 52 in the transport direction, and the tracking sensor 5 corrects the detection result of the optical detection sensor 52 based on the detection result of the mechanical detection sensor 51.

The detection result of the optical detection sensor 52 is corrected based on the detection result of the mechanical detection sensor 51 so that the erroneous detection by the optical detection sensor 52 can be avoided.

As described above, the correction of the detection result includes the correction with the detection result of the transparent part in the banknote ignored, and the correction with the detection result of the transparent part replaced similarly to the non-transparent part.

The detection result of the optical detection sensor 52 arranged downstream in the transport direction may not be corrected. For example, in the example shown in FIG. 5A etc., it may be determined that the banknote BN has passed properly if the OR signals of the two optical detection sensors $52L_{-2}$, $R_{-2}$ detect light being blocked for at least a certain period of time during the period in which the optical detection sensor $52_{-2}$ would detect the banknote BN, based on the interval (12 described above) between the mechanical detection sensor 51 and the optical detection sensor $52_{-2}$. The tracking sensor 5 determines at least the presence or absence of the transparent part W of the banknote BN based on the detection result of the mechanical detection sensor 51 and the detection result of the optical detection sensor 52.

The mechanical detection sensor 51 may be arranged upstream of the optical detection sensor 52 in the transport direction, and the handling unit may perform handling related to the banknote BN based on the time when the optical detection sensor 52 detects the end of the banknote BN.

For example, the handling unit may include the diversion unit 33, 34 disposed downstream of the mechanical detection sensor 51 in the transport direction in the transport path 31, and configured to switch the destination of the banknote BN, and the diversion unit 33, 34 may switch the destination of the banknote BN based on the time when the optical detection sensor 52 detects the end of the banknote BN.

The mechanical detection sensors 51 accurately detects the banknote BN, and thus, on the downstream side, based on the detection by the optical detection sensor 52, the handling of the banknote BN, e.g., the switching of the destination of the banknote BN can be done. In particular, in the configuration in which the detection by the optical detection sensor 52 is corrected based on the detection result of the mechanical detection sensor 51, the detection result of the optical detection sensor 52 can be accurate. Note that the handling of the banknote BN based on the detection by the optical detection sensor 52 is not limited to the diversion at the diversion unit 33, 34, and may be other kinds of handling (e.g., the acquisition of an image, the detection of a thickness, the detection of magnetic information as described above).

The tracking sensor 5 corrects the detection result of the optical detection sensor 52 if the transparent part W is present in the banknote BN, and does not correct the detection result of the optical detection sensor 52 if the transparent part W is not present in the banknote BN.

As such, if the transparent part is present in the banknote BN, the detection result of the optical detection sensor 52 is corrected, and thus the erroneous detection is avoided in advance. On the other hand, if the transparent part W is not present in the banknote BN, the detection result of the optical detection sensor 52 is accurate. Thus, the detection result of the optical detection sensor 52 is not corrected.

In the banknote handling method disclosed herein, when the banknote BN passes between the pair of rollers 511, 512 facing each other and disposed on the transport path 31 or the connection path 32 transporting the banknote BN, the displacement of the roller 512 is detected, and the banknote BN is processed based on the detection of the displacement of the roller 512.

Accordingly, the banknote BN can be detected accurately regardless of the presence or absence of the transparent part W of the banknote BN, and the handling of the banknote BN based on the erroneous detection can be avoided.

In the above embodiment, the mechanical detection sensor 51 and the optical detection sensor 52 are each arranged in two lines, but can be in three or more lines in similar manners.

(Second Variation)

In the first variation described above, the combination of the mechanical detection sensor 51 and the optical detection sensor 52 enables an appropriate detection of the end of the paper sheet even having the transparent part, and the optical detection sensor 52, which is inexpensive, is disposed on a large number of places of the transport path to reduce the cost.

Here, in addition to the combination of the mechanical detection sensor 51 and the optical detection sensor 52, it will be described below that the combination of other types of sensors is available. For example, instead of the mechanical detection sensor 51, the sensors of Patent Documents 3 to 6 etc. and an optical detection sensor etc. using ultraviolet light having a wavelength which does not transmit through the transparent part can be used depending on the properties of the transparent part of the paper sheet.

(Configuration Example of Paper Sheet Detection Device).

As described above, in the paper sheet handling device, the paper sheet detection device has a large number of detection sensors arranged along the transport path of the paper sheet. The sensor, such as the optical detection sensor 52, having a detection state changed between the transparent part and the non-transparent part of the paper sheet (i.e., the sensor not detecting the transparent part of the paper sheet as a paper sheet, and detecting the non-transparent part as a paper sheet) is inexpensive. On the other hand, the sensor, such as the mechanical detection sensor 51, having a detection state not changed between the transparent part and the non-transparent part of the paper sheet (i.e., the sensor detecting the transparent part of the paper sheet as a paper sheet, and also detecting the non-transparent part as a paper sheet) is more expensive than the optical detection sensor 52. If all of the detection sensors are constituted by expensive sensors such as the mechanical detection sensors 51, the manufacturing cost of the paper sheet detection device and the paper sheet handling device increases. Thus, the paper sheet detection device may have the following configuration.

Figure 8:
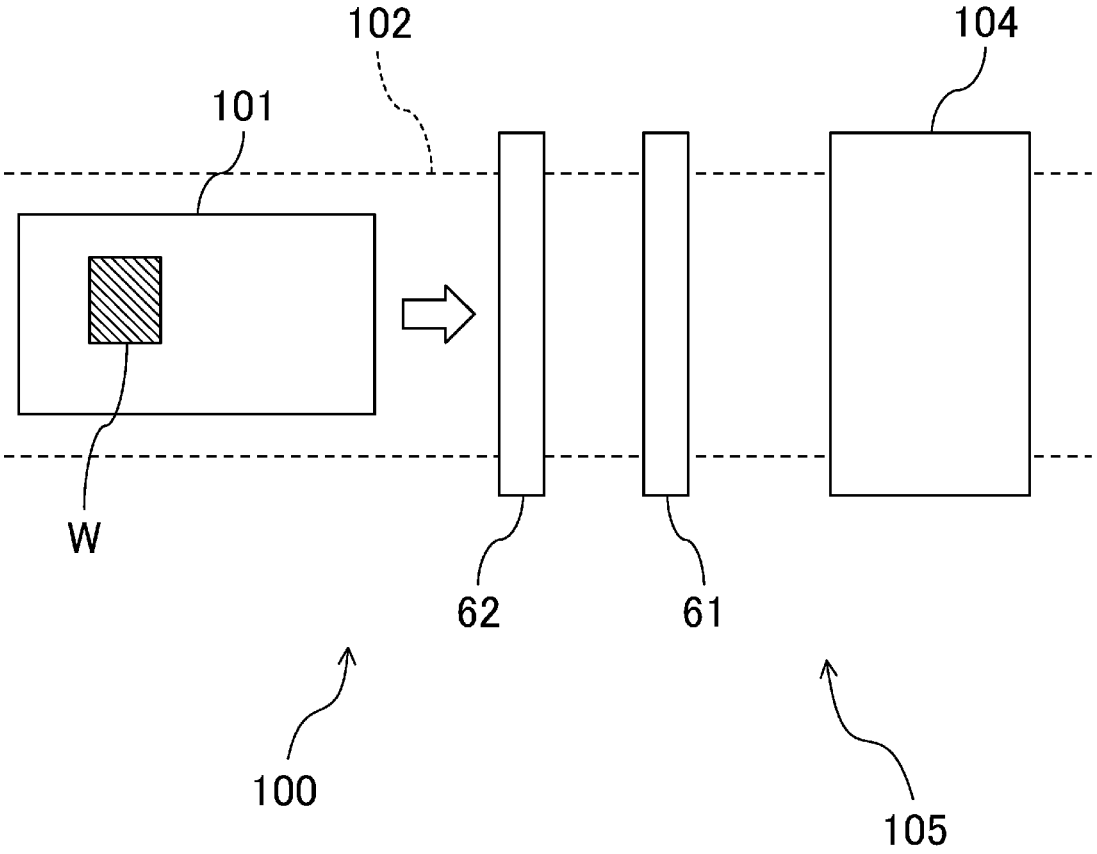
FIG. 8 is a schematic diagram of a configuration of a paper sheet detection device.

That is, a paper sheet detection device 100 is configured as illustrated in FIG. 8. The paper sheet detection device 100 of FIG. 8 have a configuration generalized from the banknote detection devices shown in FIGS. 5A to 5D.

The paper sheet detection device 100 includes a first detection sensor 61 disposed on a transport path 102 transporting a paper sheet 101, detecting the paper sheet 101, and having a detection state changed depending on a transparent part W of the paper sheet 101, and a second detection sensor 62 disposed on the transport path 102, detecting the paper sheet 101, and having a detection state not changed depending on the transparent part W of the paper sheet 101.

Here, the "first detection sensor" is a sensor that does not detect or cannot detect the transparent part of the paper sheet as a paper sheet. Thus, the detection state of the first detection sensor is changed by the transparent part. In contrast, the "second detection sensor," having the detection state not changed depending on the transparent part, is a sensor that detects or can detect the transparent part of the paper sheet as a paper sheet. Note that the second detection sensor does not need to detect the transparent part. The mechanical detection sensor 52 described above cannot detect the transparent part of the banknote, but detects the transparent part as a banknote even if the banknote has the transparent part. Thus, the mechanical detection sensor 52 is included in the second detection sensor.

This configuration allows the paper sheet detection device 100 to prevent erroneous detection of the paper sheet 101 by combination of the first detection sensor 61 and the second detection sensor 62.

A part of the detection sensors is the first detection sensor 61: Thus, the manufacturing cost of the paper sheet detection device 100 is lower than that of the configuration in which all the detection sensors are the second detection sensors 62.

The first detection sensor 61 may be an optical detection sensor that detects the paper sheet based on the light irradiated toward the paper sheet 101.

The optical detection sensor is inexpensive. Thus, the manufacturing cost of the paper sheet detection device 100 comprised of the combination of the optical detection sensor and the second detection sensor 62 decreases. Note that, as described above, the optical detection sensor may be of a transmissive type or a reflective type.

The second detection sensor 62 may be disposed upstream of the first detection sensor 61 in the transport direction.

The second detection sensor 62 can detect the end of the paper sheet 101 even if the transparent part W is arranged at the end of the paper sheet 101. If the second detection sensor 62 is disposed upstream of the first detection sensor 61 in the transport direction, the paper sheet detection device 100 can prevent erroneous detection of the paper sheet 101.

The paper sheet detection device 100 may correct the detection result of the first detection sensor 61 based on the detection result of the second detection sensor 62.

Accordingly, erroneous detection of the first detection sensor 61 can be prevented.

The paper sheet detection device 100 may detect at least the presence or absence of the transparent part W of the paper sheet 101, based on the detection result of the first detection sensor 61 and the detection result of the second detection sensor 62.

The paper sheet handling device 105 disclosed herein may include the paper sheet detection device 100 and a handling unit 104 configured to perform handling related to the paper sheet 101 based on the time when the paper sheet detection device 100 detects the end of the paper sheet 101.

The combination of the first detection sensor 61 and the second detection sensor 62 enables accurate detection of the end of the paper sheet 101. The handling unit 104 can perform handling related to the paper sheet 101 based on the time when the end of the paper sheet 101 is accurately detected, and thus is prevented from performing handling based on the time when erroneous detection is done.

Note that, as described above, "the end of the paper sheet" is either one of or both of the leading end and the trailing end of the transported paper sheet 101.

The second detection sensor 62 may be disposed upstream of the first detection sensor 61 in the transport direction, and the handling unit 104 may be configured to perform handling related to the paper sheet 101 based on the time when the first detection sensor 61 detects the end of the paper sheet 101.

Accordingly, the paper sheet 101 can be processed appropriately.

The handling unit 104 includes a diversion unit disposed downstream of the first detection sensor 61 in the transport direction in the transport path 102, and configured to switch the destination of the paper sheet 101. The diversion unit may switch the destination of the paper sheet 101 based on the time when the first detection sensor 61 detects the end of the paper sheet 101.

Accordingly, the paper sheet 101 can be transported smoothly.

Note that, in addition to the above-described mechanical detection sensor 51, "the second detection sensor having the detection state not changed depending on the transparent part of the paper sheet" disclosed herein includes the optical detection sensor disclosed in Patent Document 3 (Japanese Unexamined Patent Publication No. 2015-95023), the optical detection sensor disclosed in Patent Document 4 (Japanese Unexamined Patent Publication No. 2014-29301), the optical detection sensor disclosed in Patent Document 5 (Japanese Unexamined Patent Publication No. 2015-138437), the optical detection sensor disclosed in Patent Document 6 (Japanese Unexamined Patent Publication No. 2014-182752), or an ultrasonic detection sensor, etc. Alternatively, an optical detection sensor using ultraviolet light having a wavelength which does not transmit through the transparent part may be used.

The sensors disclosed in Patent Documents 3 to 6 has the detection accuracy of the paper sheet having the transparent part where the detection accuracy depends on the characteristics of the polymer material as described above. However, the sensors can be used as the second detection sensor 62 depending on the combination of the detection method and the polymer material.

If the polymer material is, e.g., polyester, the transmittance of ultraviolet light having a wavelength of around 400 nm or less is lowered compared to the transmittance of visible light. Thus, an optical detection sensor of which a light source is the ultraviolet light of such wavelengths can be used as the second detection sensor 62.

The "second detection sensor" may be a sensor other than the above. Further, the "first detection sensor" may be a sensor other than the above-described transmissive or reflective optical sensor as long as the detection state changes depending on the transparent part.

Note that in each of the above-described configurations, the light from the optical detection sensor 52 passes through one transparent part W, whereas if there are two or more transparent parts W, a plurality of start positions $P_C$ of the transparent parts W1 and a plurality of the lengths $P_W$ of the transparent parts W1 in the banknote BN can be stored.

Note that in the above description, the banknote handling device 1 is mainly used as an example to describe the technique disclosed herein, whereas the technology disclosed herein is widely applicable to detection and handling of valuable documents such as gift certificates and checks having a transparent part in particular.

DESCRIPTION OF REFERENCE CHARACTERS

1 Banknote Handling Device (Paper Sheet Handling Device)
21 Image Acquisition Unit (Handling Unit)
22 Thickness Detection Unit (Handling Unit)
23 Magnetic Detection Unit (Handling Unit)
31 Transport Path
32 Connection Path (Transport Path)
33, 34 Diversion Unit (Handling Unit)
5 Tracking Sensor (Paper Sheet Detection Device)
51 Mechanical Detection Sensor
52 Optical Detection Sensor
511 Driving Roller (Rolling Body)
512 Driven Roller (Rolling Body)
519 Detection Unit
BN Banknote (Paper Sheet)

The invention claimed is:

1. A paper sheet handling device, comprising:

a paper sheet detection device arranged on a transport path for transporting a paper sheet and configured to detect the paper sheet, and a handling unit configured to perform handling related to the paper sheet based on the time when the paper sheet detection device detects an end of the paper sheet, wherein the paper sheet detection device includes a mechanical detection sensor including at least a pair of rolling bodies which face each other and between which the paper sheet passes, and a detection unit detecting a displacement of the rolling body when the paper sheet passes between the pair of rolling bodies facing each other in order to detect the end of the paper sheet, the paper sheet detection device further includes a transmissive or reflective optical detection sensor:

having a light emission unit and a light reception unit, and arranged such that an optical axis of the light emission unit intersects the transport path, the optical detection sensor includes a plurality of optical detection sensors arranged:

in specific locations of the transport path, and in a direction orthogonal to a transport direction of the paper sheet, each of the plurality of optical detection sensors detects the paper sheet, the mechanical detection sensor includes a plurality of mechanical detection sensors arranged:

in locations upstream of the optical detection sensor in the transport direction in the transport path, and in a direction orthogonal to the transport direction of the paper sheet, each of the plurality of mechanical detection sensors detects the paper sheet, and the paper sheet detection device corrects detection results of the plurality of optical detection sensors based on detection results of the plurality of mechanical detection sensors, wherein in case detection results of the plurality of mechanical detection sensors are different from detection results of the plurality of optical detection sensors, the paper sheet detection device corrects a detection result of a part, which is not detected by the plurality of optical detection sensors, by changing the detection result to a state in which the part is indicated as detected by the plurality of optical detection sensors, in the detection results of the plurality of optical detection sensors.

2. The paper sheet handling device of claim 1, wherein the handling unit is an image acquisition unit disposed downstream of the mechanical detection sensor in a transport direction in the transport path, and configured to acquire an image of the paper sheet, and the image acquisition unit acquires the image of the paper sheet based on the time when the mechanical detection sensor detects the end of the paper sheet.

3. The paper sheet handling device of claim 1, wherein the handling unit is a thickness detection unit disposed downstream of the mechanical detection sensor in the transport direction in the transport path, and configured to detect a thickness of the paper sheet, and the thickness detection unit detects the thickness of the paper sheet based on the time when the mechanical detection sensor detects the end of the paper sheet.

4. The paper sheet handling device of claim 1, wherein the handling unit is a diversion unit disposed downstream of the mechanical detection sensor in the transport direction in the transport path, and configured to switch a destination of the paper sheet, and the diversion unit switches the destination of the paper sheet based on the time when the mechanical detection sensor detects the end of the paper sheet.

5. The paper sheet handling device of claim 1, wherein the paper sheet detection device detects at least a presence or absence of a transparent part of the paper sheet, based on the detection result of the mechanical detection sensor and the detection result of the optical detection sensor.

6. The paper sheet handling device of claim 1, wherein the handling unit performs handling related to the paper sheet based on the time when the optical detection sensor detects the end of the paper sheet.

7. The paper sheet handling device of claim 6, wherein the handling unit is a diversion unit disposed downstream of the optical detection sensor in the transport direction in the transport path, and configured to switch a destination of the paper sheet, and the diversion unit switches the destination of the paper sheet based on the time when the optical detection sensor detects the end of the paper sheet.

8. The paper sheet handling device of claim 1, wherein the at least the pair of rolling bodies include a driving roller and a driven roller, wherein the driven roller is rotatably supported by a roller support, wherein the roller support is pivotally supported around a shaft, and pivotable in a direction to move away from the driving roller.

9. The paper sheet handling device of claim 8, wherein the paper sheet detection device additionally comprises:

a sensor body, and a compression spring disposed between the roller support and the sensor body.

10. The paper sheet handling device of claim 9, wherein the roller support has an upper end to which a magnet is attached, and wherein the detection unit additionally comprises a plurality of Hall elements attached to the sensor body so as to face the magnet.

11. The paper sheet handling device of claim 1, wherein each of the plurality of the mechanical detection sensors are respectively located on same lines extending in the transport direction as respective optical detection sensors of the plurality of the optical detection sensors.

12. A paper sheet handling device, comprising:

a paper sheet detection device arranged on a transport path for transporting a paper sheet and configured to detect the paper sheet, and a handling unit configured to perform handling related to the paper sheet based on the time when the paper sheet detection device detects an end of the paper sheet, wherein the paper sheet detection device includes a mechanical detection sensor including at least a pair of rolling bodies which face each other and between which the paper sheet passes, and a detection unit detecting a displacement of the rolling body when the paper sheet passes between the pair of rolling bodies facing each other in order to detect the end of the paper sheet, the paper sheet detection device further includes a transmissive or reflective optical detection sensor:

having a light emission unit and a light reception unit, and arranged such that an optical axis of the light emission unit intersects the transport path, the optical detection sensor includes a plurality of optical detection sensors arranged:

in specific locations of the transport path, and in a direction orthogonal to a transport direction of the paper sheet, each of the plurality of optical detection sensors detects the paper sheet, the mechanical detection sensor includes a plurality of mechanical detection sensors arranged:

in locations upstream of the optical detection sensor in the transport direction in the transport path, and in a direction orthogonal to the transport direction of the paper sheet, each of the plurality of mechanical detection sensors detects the paper sheet, and the paper sheet detection device corrects detection results of the plurality of optical detection sensors based on detection results of the plurality of mechanical detection sensors wherein the handling unit is a magnetic detection unit disposed downstream of the mechanical detection sensor in the transport direction in the transport path, and configured to detect magnetic information of the paper sheet, and the magnetic detection unit detects the magnetic information of the paper sheet based on the time when the mechanical detection sensor detects the end of the paper sheet.

13. A paper sheet handling method, using a paper sheet handling device including:

a paper sheet detection device arranged on a transport path for transporting a paper sheet and configured to detect the paper sheet, and a handling unit configured to perform handling related to the paper sheet, the paper sheet detection device including a mechanical detection sensor including at least a pair of rolling bodies which face each other and between which the paper sheet passes, and a detection unit detecting a displacement of the rolling body when the paper sheet passes between the pair of rolling bodies facing each other in order to detect an end of the paper sheet, the paper sheet detection device further including a transmissive or reflective optical detection sensor:

having a light emission unit and a light reception unit, and arranged such that an optical axis of the light emission unit intersects the transport path, the optical detection sensor including a plurality of optical detection sensors arranged:

in specific locations of the transport path, and in a direction orthogonal to a transport direction of the paper sheet, each of the plurality of optical detection sensors detecting the paper sheet, the mechanical detection sensor including a plurality of mechanical detection sensors arranged:

in locations upstream of the optical detection sensor in the transport direction in the transport path, and in a direction orthogonal to the transport direction of the paper sheet, and each of the plurality of mechanical detection sensors detecting the paper sheet, the method comprising:

detecting a displacement of the pair of rolling bodies when the paper sheet passes between the pair of rolling bodies, performing handling related to the paper sheet by the handling unit based on the detection of an end of the paper sheet by displacement of the rolling body, and correcting detection results of the plurality of optical detection sensors based on detection results of the plurality of mechanical detection sensors by the paper sheet detection device, wherein in case detection results of the plurality of mechanical detection sensors are different from detection results of the plurality of optical detection sensors, the paper sheet detection device corrects a detection result of a part, which is not detected by the plurality of optical detection sensors, by changing the detection result to a state in which the part is indicated as detected by the plurality of optical detection sensors, in the detection results of the plurality of optical detection sensors.

* * * * *